US010358193B2

(12) United States Patent
Lobisser

(10) Patent No.: US 10,358,193 B2
(45) Date of Patent: Jul. 23, 2019

(54) HYDROFOIL ASSEMBLY FOR WATERSPORTS AND ASSOCIATED METHODS OF MANUFACTURE

(71) Applicant: Adherend Innovations, LLC, Los Altos, CA (US)

(72) Inventor: G. Kyle Lobisser, Bainbridge Island, WA (US)

(73) Assignee: Adherend Innovations, LLC, Los Altos, CA (US)

( * ) Notice: Subject to any disclaimer, the term of this patent is extended or adjusted under 35 U.S.C. 154(b) by 27 days.

(21) Appl. No.: 15/481,270

(22) Filed: Apr. 6, 2017

(65) Prior Publication Data

US 2017/0355429 A1 Dec. 14, 2017

Related U.S. Application Data

(60) Provisional application No. 62/347,769, filed on Jun. 9, 2016.

(51) Int. Cl.

| | |
|---|---|
| ***B63B 1/24*** | (2006.01) |
| ***B63B 35/79*** | (2006.01) |
| ***B63B 1/26*** | (2006.01) |

(52) U.S. Cl.

CPC ..... *B63B 35/7923* (2013.01); *B63B 1/24* (2013.01); *B63B 1/248* (2013.01); *B63B 1/26* (2013.01); *B63B 35/79* (2013.01)

(58) Field of Classification Search

CPC ..... B63B 1/248; B63B 35/7923; B63B 1/24; B63B 1/242; B63B 1/26; B63B 35/79

See application file for complete search history.

(56) References Cited

U.S. PATENT DOCUMENTS

| | | | | |
|---|---|---|---|---|
| 3,669,589 | A * | 6/1972 | Bordat | B29C 33/123 249/159 |
| 5,211,594 | A * | 5/1993 | Barrows | B63B 1/248 114/274 |
| 9,278,739 | B2 * | 3/2016 | Salles | B63B 1/242 |
| 9,586,651 | B2 * | 3/2017 | Modica | B63B 1/24 |
| 9,643,694 | B2 * | 5/2017 | Geislinger | B63B 35/7926 |

* cited by examiner

*Primary Examiner* — Ajay Vasudeva

(74) *Attorney, Agent, or Firm* — Fortem IP LLP; Mary Fox

(57) ABSTRACT

Hydrofoil assemblies that can be attached to a board used for watersports are disclosed herein. A hydrofoil assembly may include, for example, a mast a coupleable to a fuselage at a lower portion of the mast and coupleable to a board at an upper portion of the mast, and front and rear wings coupleable to the fuselage. A hydrofoil mast may include, for example, first and second composite sections bonded together to form a hollow load-bearing mast structure. Leading and trailing elements made of a material that is softer than the composite mast structure may be adhered to the mast structure to complete a hydrodynamic profile of the mast.

17 Claims, 11 Drawing Sheets

HYDROFOIL ASSEMBLY FOR WATERSPORTS AND ASSOCIATED METHODS OF MANUFACTURE

CROSS-REFERENCE TO RELATED APPLICATION(S)

The present application claims the benefit of U.S. Provisional Patent Application No. 62/347,769, filed Jun. 9, 2016, which is incorporated herein by reference in its entirety.

TECHNICAL FIELD

The present technology relates generally to a hydrofoil assembly that can be attached to a board used for watersports. Some embodiments of the present technology relate to hydrofoil components and associated methods of manufacture.

BACKGROUND

Hydrofoil boards (i.e., a hydrofoil attached to a watersports board) are becoming increasingly popular for watersports. The most common applications for hydrofoil boards are currently kitesurfing (also referred to as kiteboarding), windsurfing, and standup paddleboarding ("SUP"). Hydrofoil boards can be more attractive to watersport athletes than watersports boards alone (e.g., traditional SUP boards, surfboards, and windsurfing/kitesurfing boards) because they offer reduced drag and permit riders to achieve higher speeds and angles-of-attack upwind. Hydrofoil boards allow athletes to participate in water-based windsports with less wind, use smaller kites and sails, and travel farther and faster. Such boards have become popular on racing circuits, and could potentially displace traditional boards.

Though recent advances in technology have improved the performance of hydrofoil boards in watersports, existing hydrofoil designs often contain sharp and hard edges and are relatively heavy, expensive, and difficult to repair. Sharp and hard edges are a danger to riders because they can cause lacerations or other physical injury to the rider. This problem is compounded by the fact that many watersports that use a hydrofoil board also involve frequent crashes into the water. Heavy hydrofoil designs make transporting the board more difficult, increase the difficulty of learning to use the hydrofoil board, and reduce performance. Finally, existing designs involve integral components that make repair and replacement expensive and difficult. For example, damage to a single component of hydrofoils currently on the market often requires total replacement of the component or even replacement of the entire hydrofoil. Accordingly, there exists a need for improved hydrofoil assemblies.

FIGS. 1A-1D are cross-sectional end views of different prior-art designs for a hydrofoil mast (labeled individually as 10*a-d*), each having a hydrodynamic profile with a leading edge 18 and a trailing edge 16. Mast 10*a* (FIG. 1A) is formed of a single piece of composite material molded into the desired shape of the mast. Unlike masts 10*b-d*, mast 10*a* does not contain any hollow regions. Using a composite material is beneficial because composite materials have high strength-to-weight and stiffness-to-weight ratios. However, current methods for manufacturing composite materials with hollow sections are complex and expensive. Thus, current composite designs either employ a solid design and do not include hollow regions to reduce weight, or require complicated and expensive manufacturing techniques to form a single hollow region (e.g., closed-mold tooling). Masts

10*b-d* (FIGS. 1B-1D) are made of a single piece of extruded aluminum and thus avoid the aforementioned design constraints of composite materials. For example, masts 10*b-d* include various hollow regions 17 which reduce the weight of the respective mast (as compared to a solid piece of aluminum having the same cross-sectional area). To compensate for the loss of structural support created by the hollow regions 17, masts 10*b-d* are extruded to include spars 11 and/or rounded support sections 13 spanning or extending into one or more of the hollow regions 17. For example, FIG. 1B shows an extruded aluminum design including a single support spar 11 and two hollow regions 17. FIG. 1C shows an extruded aluminum design including first and second rounded support sections 13*a* and 13*b* and first and second spars 11*a* and 11*b*. FIG. 1D shows an extruded aluminum design including first and second rounded support sections 13*a* and 13*b*.

DETAILED DESCRIPTION

Figure 1A:
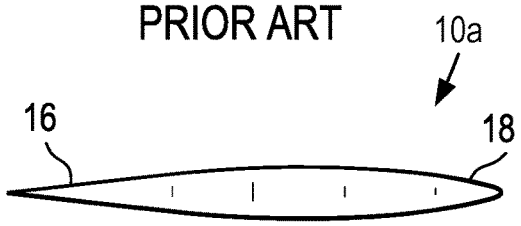
FIG. 1A PRIOR ART
FIGS. 1A-1D are cross-sectional end views of different prior-art designs for a hydrofoil mast.
Figure 1B:
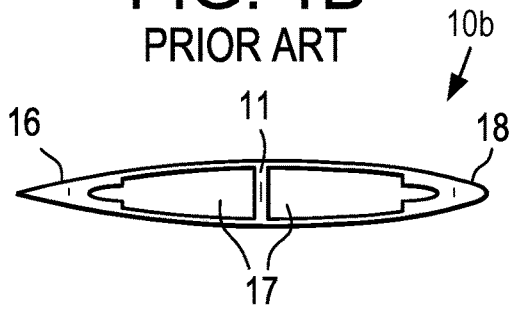
FIG. 1B PRIOR ART
Figure 1C:
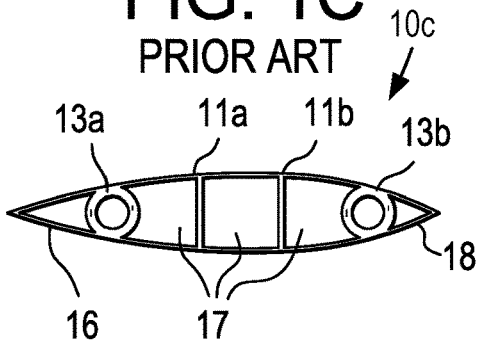
FIG. 1C PRIOR ART
Figure 1D:
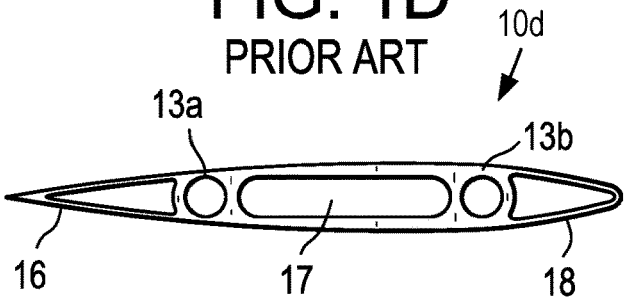
FIG. 1D PRIOR ART

Aspects of the present disclosure are directed generally toward hydrofoil assemblies for attachment to a watersports board and associated methods of manufacture. As used herein, the term "watersports board" refers to any board suitable for watersports, such as those used in kitesurfing, windsurfing, wakeboarding, surfing, stand-up paddle boarding, and the like. An overview of a novel hydrofoil assembly in accordance with the present technology is described below under heading 1.0. Particular embodiments of various subcomponents of the hydrofoil assemblies of the present technology are described below under headings 2.0-5.0. More specifically, selected embodiments of hydrofoil masts and associated methods of manufacture are described further under heading 2.0. Selected embodiments of lower hydrofoil assemblies-including selected embodiments of hydrofoil wings, hydrofoil fuselages, and associated methods of manufacture—are described further under heading 3.0. Selected alternate embodiments of hydrofoil masts and associated methods of manufacture are described further under heading 4.0. Lastly, selected embodiments of a connection element for connecting components of the hydrofoil assembly are described below under heading 5.0.

The terminology used in the description presented below is intended to be interpreted in its broadest reasonable manner, even though it is being used in conjunction with a detailed description of certain specific embodiments of the disclosure. Certain terms may even be emphasized below; however, any terminology intended to be interpreted in any restricted manner will be overtly and specifically defined as such in this Detailed Description section.

As used herein, the terms "leading" and "trailing," unless otherwise specified, refer to the relative positions or directions of features of the hydrofoil assembly and/or associated devices with reference to a direction of movement of the hydrofoil assembly while in use.

As used herein, the terms "upper," "upwards," "lower," "downwards," "left" and "right" refer to relative positions or directions of features of the hydrofoil assembly and/or associated devices from the perspective of a rider when using the hydrofoil assembly as it is typically used for watersports.

1.0 OVERVIEW

Figure 2:
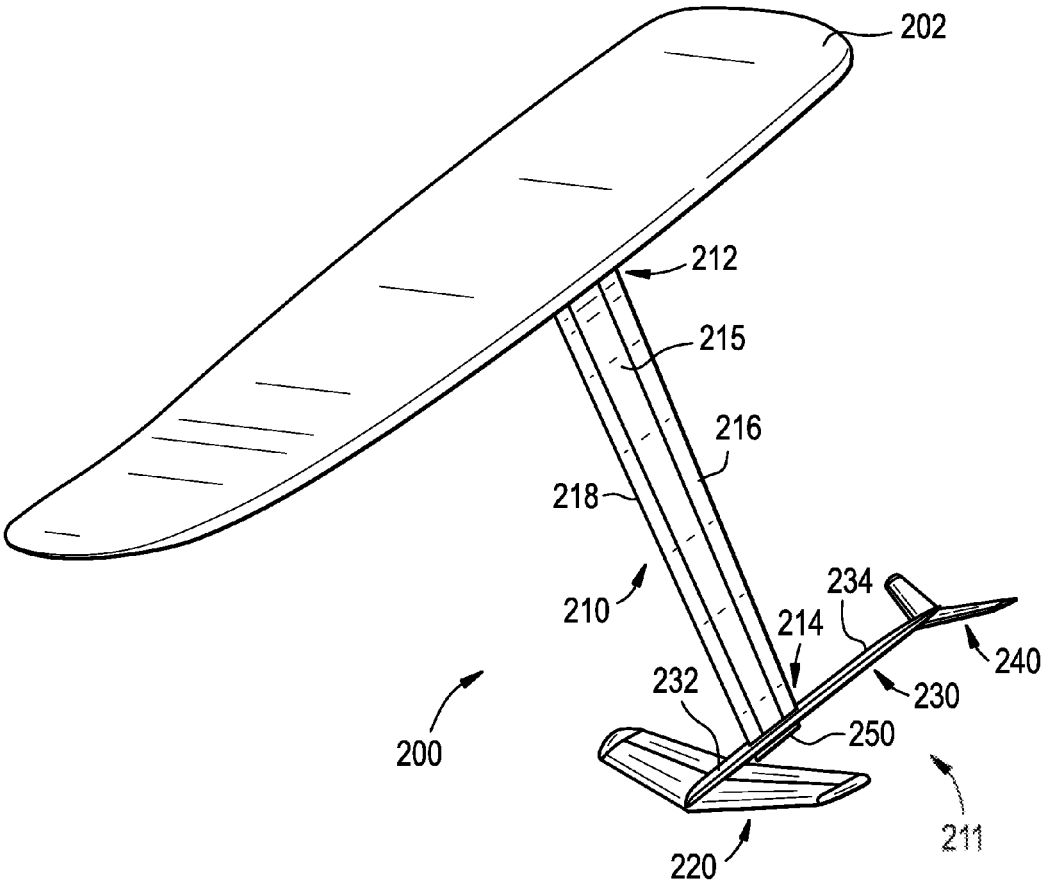
FIG. 2 is an isometric view of a hydrofoil assembly configured in accordance with the present technology, shown attached to a board for watersports.

FIG. 2 illustrates one embodiment of a hydrofoil assembly 200 in accordance with the present technology, shown coupled to a watersports board 202. As shown in FIG. 2, the hydrofoil assembly 200 includes a mast 210 and a lower assembly 211. The mast 210 is a composite structure that includes a mast structure 215 formed of a composite material and leading and trailing elements 218 and 216 coupled to opposing sides of the mast structure 215. As described in greater detail below, in some embodiments the leading element 218 and/or the trailing element 216 can easily be attached to/detached from the mast structure 215 to allow for customization of the hydrodynamic profile of the mast 210 and/or repair of one or more mast components. The mast 210 further includes an upper portion 212 configured to be detachably or permanently coupled to a watersports board (such as board 202 shown in FIG. 2), and a lower portion 214 configured to be detachably or permanently coupled to the lower assembly 211. In the embodiment shown in FIG. 2, the hydrofoil assembly 200 includes a connection element 250 for securing the lower portion 214 of the mast 210 to one or more components of the lower assembly 211 (such as fuselage 230, described below). In other embodiments, the mast 210 can be permanently or detachably coupled to the lower assembly 211 by other securing means, as described in greater detail below. In yet other embodiments, the mast 210 and/or one or more components of the lower assembly 211 are integrally formed.

2.0 SELECTED EMBODIMENTS OF HYDROFOIL MASTS AND METHODS OF MANUFACTURE

Figure 3:
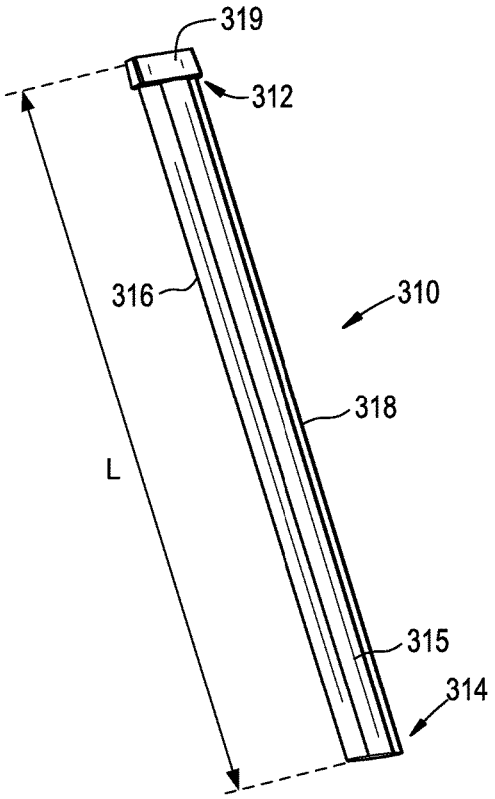
FIGS. 3 and 4 are isometric and cross-sectional end views, respectively, of one embodiment of a hydrofoil mast configured in accordance with the present technology.
Figure 4:
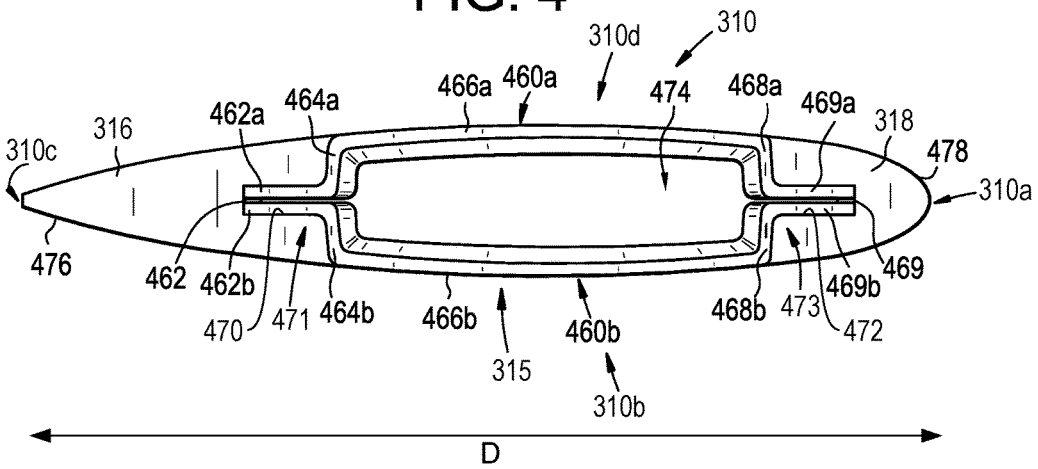

FIGS. 3 and 4 are isometric and cross-sectional end views, respectively, of an embodiment of an assembled hydrofoil mast 310 in accordance with the present technology. Referring to FIGS. 3 and 4 together, the mast 310 includes features generally similar to the features of the mast 210 shown in FIG. 2. For example, the mast 310 includes a mast structure 315, a trailing element 316, and a leading element 318. The mast 310 further includes a left side 310*d* (only visible in FIG. 4), a right side 310*b*, a leading edge 310*a*, and a trailing edge 310*c*. The mast 310 optionally includes a connection adapter 319 coupled to the upper portion 312 of the mast 310 for securing the upper portion 312 to a board, as described in greater detail below.

The mast structure 315 extends along the length L of the mast 310 and is configured to bear the load of a watersports board and rider while the hydrofoil assembly 300 is in the water. Moreover, the mast structure 315 is configured to withstand significant lateral, torsional, and bending forces applied to the hydrofoil assembly and/or attached board during use. As best shown in the cross-sectional end view of FIG. 4, the mast structure 315 is a composite structure formed of multiple, discrete sections or structural components made of a molded, composite material (e.g., a carbon fiber material, a fiberglass material, a combination of multiple fiber reinforced plastic materials, etc.). In other embodiments, the mast structure 315 may be made of a metallic material (e.g., steel or aluminum). However, while metallic materials may be cheaper than composite materials, they generally provide reduced performance and weight characteristics. The mast structure 315 shown in FIG. 4 includes two sections 460 (referred to individually and labeled as "first section 460*a* and second section 460*b*"), in other embodiments the mast structure 315 may include a single continuous section (as shown in, e.g., FIG. 11), or more than two discrete sections (i.e., three discrete sections, four discrete sections, etc.).

As shown in FIG. 4, the first section 460*a* of the mast structure 315 includes a trailing flange 462*a*, a trailing spar 464*a* extending from the trailing flange 462*a* towards the left side 310*d* of the mast 310, a span portion 466*a* extending from the trailing spar 464*a* towards the leading edge 310*a* of the mast 310, a leading spar 468*a* extending from the span portion 466*a* towards the right side 310*b* of the mast 310, and a leading flange 469*a* extending from the leading spar 468*a* towards the leading edge 310*a* of the mast 310. Likewise, the second section 460*b* includes a trailing flange 462*b*, a trailing spar 464*b* extending from the trailing flange 462*b* towards the right side 310*b* of the mast 310, a span portion 466*b* extending from the trailing spar 464*b* towards the leading edge 310*a* of the mast 310, a leading spar 468*b* extending from the span portion 466*b* towards the left side 310*d* of the mast 310, and a leading flange 469*b* extending from the leading spar 468*b* towards the leading edge 310*a* of the mast 310. In the embodiment shown in FIG. 4, the trailing spars 464*a*/464*b* and leading spars 468*a*/468*b* extend generally orthogonal to a depth dimension D of the mast 310.

The span portions 466*a* and 466*b* can be slightly curved, and combine with the trailing element 316 and the leading element 318 to define the hydrodynamic profile of the mast 310. In some embodiments the first and second sections 460*a*, 460*b* have a uniform thickness. However, in other embodiments the first and second sections 460*a*, 460*b* may have a varying thickness. For example, some components may be tapered to, for example, reduce the weight of the mast 310 and/or improve the hydrodynamic profile of the mast.

The first and second sections 460*a*, 460*b* can be bonded together at their respective trailing flanges 462*a*, 462*b* and leading flanges 469*a*, 469*b* to form a main trailing flange 462 and a main leading flange 469, respectively. In other embodiments, the first and second sections 460*a*, 460*b* can be co-cured or co-bonded together to eliminate a manufacturing step. Alternatively, if a thermoplastic material is used, the first and second sections 460*a*, 460*b* can be welded together. In certain embodiments, the mast structure 315 and/or the first and second sections 460*a* and 460*b* do not include a flange. In such embodiments, the first and second sections 460*a* and 460*b* can instead be bonded together at the spar portions 464*a*/464*b* and 468*a*/468*b* (as shown in, e.g., FIGS. 9 and 10).

As shown in FIG. 4, the first and second sections 460*a*, 466*b* can be reflectively symmetric about a plane extending between flange portions 464*a*/464*b* and 468*a*/468*b*. A symmetrical profile can help reduce drag by encouraging laminar flow of the water passing by the mast 310. In the assembled configuration, the inner surfaces of the first section's trailing spar 464*a*, span portion 466*a*, and leading spar 468*a* and the inner surfaces of the second section's trailing spar 464*b*, span portion 466*b*, and leading spar 468*b* together surround and define a channel 474 extending the length of the mast structure 315. In other embodiments, the mast structure 315 may define two or more channels. The portions of the first and second sections 460*a*, 460*b* that define the channel 474 can together form a generally rectangular cross-sectional shape with curved sides. In other embodiments, the mast structure 315 can have other shapes and configurations (as shown in, e.g., FIGS. 8-11). In addition, the outer surfaces of the trailing flanges 462*a*, 462*b* and the trailing spars 464*a*, 464*b* together define a trailing surface 470 of the mast structure 315 (or the outer surface of the main trailing flange 462), and the outer surfaces of the leading flanges 469*a*, 469*b* and the leading spars 468*a*, 468*b* together define a leading surface 472 of the mast structure 315 (or the outer surface of the main leading flange 469).

In contrast to the mast structure 315, the leading and trailing elements 318, 316 are not configured to be load bearing and function primarily to define the hydrodynamic profile of the mast. As such, the leading and trailing elements 318, 316 can be fabricated from materials softer than the composite materials used to make the mast structure 315. For example, the leading and trailing elements 318, 316 can be made from either thermoplastic or thermosetting polymers including ABS, silicone, polyurethane, or other similar materials in varying density from solid to foam. In some embodiments the leading and trailing elements 318, 316 can be artistic in nature, and can be fabricated from natural materials such as wood, to give the mast 310 unique properties and a unique appearance. This construction improves the safety of the hydrofoil by, for example, reducing the likelihood of injuring the rider during a fall. Furthermore, damage tolerance and durability of the mast 310 are improved.

The leading and trailing elements 318, 316 can have a cross-sectional shape selected based on a desired hydrodynamic profile. In the embodiment shown in FIG. 3, the leading element 318 has a blunted or curved shape that tapers towards the leading side of the mast 310, while the trailing element 316 is longer and tapers towards the trailing side of the mast 310. In other embodiments, the leading and/or trailing elements 318, 316 may have other suitable shapes (e.g., a triangular cross-section, an oval-shaped cross-section, a circular or semi-circular cross-section, one or more linear outer surfaces and/or one or more curved outer surfaces, etc.). In certain embodiments, the leading and trailing elements 318, 316 are detachably coupled to the mast 310 such that a rider can easily interchange different leading and trailing elements based on a desired hydrodynamic profile. For example, the surface of flanges 462 and 469 can contain indexing features to provide an interference fit with the leading/trailing elements (as shown in, e.g., FIGS. 12 and 13). With such features a rider might select different leading and trailing elements depending on wind conditions, water conditions, rider ability level, and/or desired performance. For example, a beginner rider may prefer softer, tougher leading and trailing elements for improved safety and durability while a competitive rider might want lower drag, lighter weight elements for improved performance.

Figure 5:
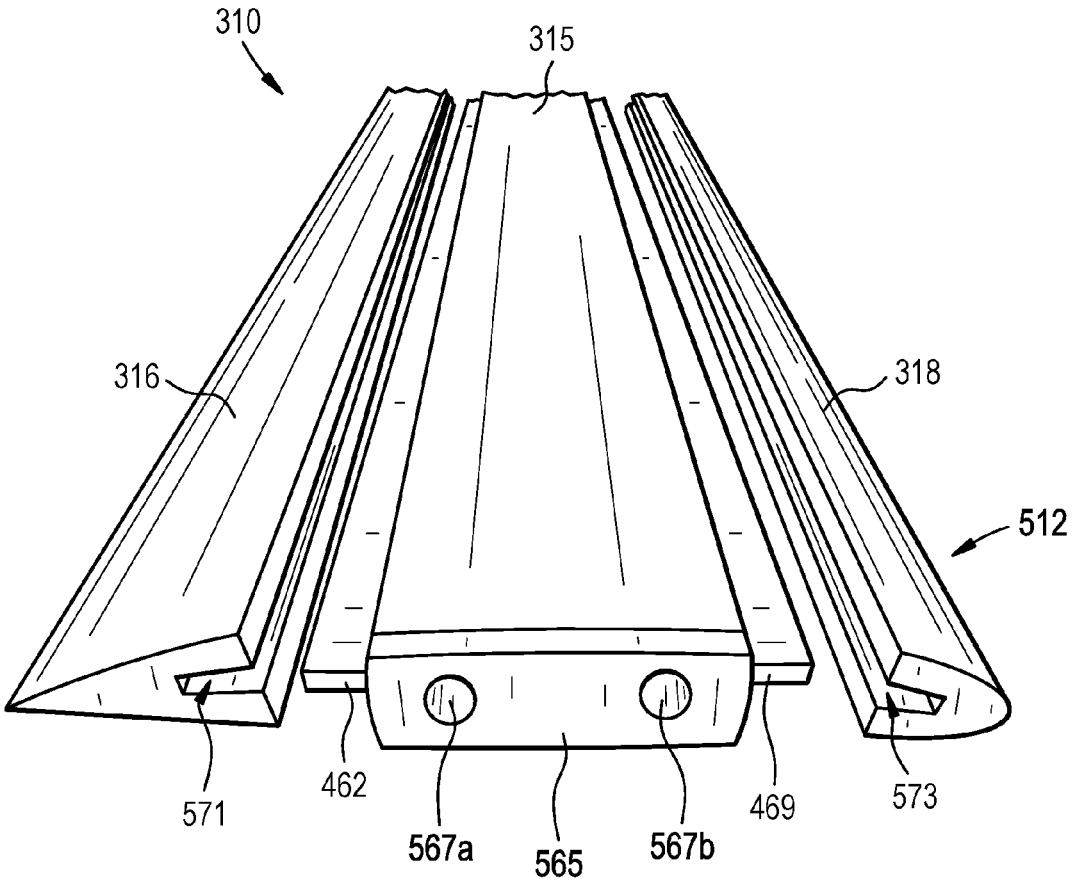
FIG. 5 is a partially-exploded, isometric view of the upper portion of the hydrofoil mast shown in FIGS. 3 and 4.

FIG. 5 shows an exploded, isometric view of the upper portion of the hydrofoil mast 310. Referring to FIGS. 4 and 5 together, each of the trailing and leading elements 316 and 318 can include an elongated slot 471 and 473, respectively, extending along all or a portion of their respective lengths. Each of the slots 471, 473 is configured to receive therein the corresponding main trailing flange 362 and main leading flange 369, respectively. Specifically, the slots 471, 473 can be shaped such that they fit snuggly against the flanges 462 and 469 (as illustrated in FIG. 4), in order to provide a greater bonding surface and to prevent water from entering the slots 561 and 563. In some embodiments, all or a portion of an inner surface of the trailing element 316 surrounding the slot 471 can be adhered to all or a portion of the trailing surface 470, and/or all or a portion of an inner surface of the leading element 318 surrounding the slot 473 can be adhered to all or a portion of the leading surface 472. In other embodiments, the mast structure 315 can be coupled to one or both of the leading and trailing elements 318, 316 via other suitable attachment means. For example, in some embodiments, the leading and trailing elements 318, 316 can be permanently mounted to the mast structure 315 via "insert molding," in which the mast structure 315 is placed into a mold and the leading and trailing elements 318, 316 are injected around the mast structure 315. Insert molding requires expensive tooling but can yield a clean surface for the leading and trailing elements 318, 316 and reduce manufacturing variability.

A method for forming a hydrofoil mast in accordance with the present technology is now described. First, multiple plies of composite material are placed into a mold. In some embodiments, depending on the properties of the composite material, as few as 10 or as many as 20 plies are placed in the mold. However, depending on the strength and stiffness characteristics of the plies, even fewer plies may be adequate. In certain embodiments, 17 plies are placed in the mold to form a section 460 of the mast structure 315. Higher performance materials such as high modulus carbon or boron will require fewer plies than layups consisting of fiberglass or lower-modulus carbon fiber. The orientation of each ply is engineered to provide desired bending stiffness, bending strength, torsional stiffness, and torsional strength characteristics. In some embodiments, the plies can include unidirectional fibers to reduce cost, while also yielding a section 460 with the required strength and stiffness since the mast structure 315, in operation, generally bears highly directional loads. In other embodiments, the plies contain woven fibers which can be used to produce a section 460 with more quasi-isotropic strength and stiffness properties. Next, the sheets are oven-cured and shaped using a vacuum bagging system, compression molded, resin transfer molded, or stamped. Depending on desired rates of fabrication, tooling can be adjusted to better serve the market. For example, in quantities of 100 s/year, oven curing can be an adequate process. In 1,000 s/year, compression molding can be a more efficient process. In 10,000 s/year, resin transfer molding can yield a cheaper part. In quantities of 100,000 s/year, stamping thermoplastics can quickly yield a part. In other embodiments, the first and second sections 460*a*, 460*b* may be stamped, pressed, or formed from metallic materials such as, for example, steel or aluminum.

Once formed, the first and second sections 460*a*, 460*b* can be bonded together. As described above, in some embodiments the first and second sections 460*a* and 460*b* can be bonded together at or along their respective flange portions 462*a*/462*b* and 469*a*/469*b*. In other embodiments, the first and second sections 460*a*, 460*b* can be bonded together at or along their respective spar portions 464*a*/464*b* and 468*a*/468*b*. Regardless of where the first and second sections 460*a*, 460*b* are bonded together, bonding can be achieved by dispensing a paste adhesive between the surfaces to be bonded and employing a fixture that provides adequate pressure over the bonded surfaces in a consistent manner. Such a fixture can also control the thickness of the flange portions 462*a*/462*b* and 469*a*/469*b* during cure, so that secondary elements (e.g., the leading and trailing elements 318, 316) fit properly. In some embodiments, an adhesive in the form of a thin film of given thickness (known as "film adhesive") can also be used to bond the two structures. A suitable adhesive may be cured at room temperature or elevated temperature, and the heat may come from the fixture itself or by means of an oven. Other components of the hydrofoil mast 310 can be adhered together at the same time as the first and second sections 460*a*, 460*b*. For example, two or more sections of a connection interface (described in further detail below with reference to FIG. 5) may also be adhesively bonded together at the same times as the first and second sections 460*a*, 460*b*. Furthermore, in some embodiments, additional structural members such as stringers, spars, or ribs can be integrated with the first and/or second sections 460*a*, 460*b* during bonding for further optimization and weight reduction (as shown in, e.g., FIGS. 14 and 15).

Once the mast structure 315 is assembled, the trailing element 316 can be coupled to the trailing surface 470 and the leading element 318 can be coupled to the leading surface 472 in order to complete the hydrodynamic profile of the mast 310. As described above, the trailing and leading elements 316, 318 can be adhesively bonded to the mast structure via one or more of the flanges 462/469 or spar portions 464*a*/464*b* and 468*a*/468*b*. A suitable process for adhesively bonding the trailing and leading elements 316, 318 to the first and second sections 460*a*, 460*b* includes applying an adhesive to the trailing and elements 316, 318 and then pressing them directly onto the main flanges 462, 469 of the mast structure 310. For example, an adhesive can be disposed within the slot 471 of the trailing element 316 and the slot 473 of the leading element 318. Continuous pressure is applied during the cure of the adhesive to ensure accurate placement and a suitably strong adhesive bond. In other embodiments, the trailing and leading elements 316, 318 are detachably coupled to the mast structure 315 via other suitable mechanisms. For example, trailing and leading elements 316, 318 can be attached to the mast via clips, locking grooves, or other suitable mechanisms. In some embodiments, the trailing and leading elements 316, 318 are configured to yield an interference fit against the main flanges 462, 469 that does not require an adhesive or other coupling mechanism. In certain embodiments, the trailing and leading elements 316, 318 can be secured against the mast structure 315 by another component of the hydrofoil assembly. For example, a recess in the board or fuselage can fit over the upper or lower portions of the trailing and leading elements 316, 318 such that the elements 316, 318 are sandwiched between the mast structure 315 and the walls of the recess. In other embodiments, additional components such as the connection adapter 319 can be used to couple the trailing and leading elements 316, 318 to the mast structure 315. The connection adapter 319 can be configured to provide an interface for connecting the mast 310 to water-sports boards with different attachment standards.

In some embodiments, the trailing and leading elements 316, 318 are three-dimensionally printed from ABS plastic. In other embodiments, the trailing and leading elements 316, 318 can be made of silicone and injection molded. As a lower cost option, the trailing and leading elements 316, 318 can be cast in a mold using a urethane-based material. In yet other embodiments, the trailing and leading elements 316, 318 can be made of any suitably strong and soft material, and can be formed by other suitable processes. Among the advantages detailed herein, using softer trailing and leading elements 316, 318 improves the durability of the mast. Specifically, such materials are less brittle than epoxy and aluminum, and are therefore less likely to be damaged by abuse loads such as resting the hydrofoil on the beach, loading it into a car, or impact with floating objects in the water. In the event of damage to the trailing or leading elements 316 or 318, they can be easily removed and replaced, avoiding the high cost of complete replacement of the hydrofoil mast.

The methods for manufacturing the hydrofoil assemblies as described herein reduce manufacturing costs and simplify manufacturing compared to the methods currently employed for manufacturing conventional hydrofoils. For example, conventional methods utilize matched-metal, closed-mold tooling, and require high pressures and levels of precision to achieve a quality, solid section mast. Manufacturing hollow structures requires complicated and custom-made inflatable bladders or vacuum bagging to apply sufficient pressure to an interior surface of the composite structure during curing. In contrast, by forming a hollow mast structure 315 from two open composite sections 460*a* and 460*b*, the present technology significantly reduces tooling costs. Specifically, the molds required to form each section 460*a* and 460*b* require only one "hard" or "tooled" side (e.g., machined aluminum, steel, or foam). The other "soft" side of the mold can comprise, for example, a vacuum bag or silicone intensifier to apply pressure to the layup of composite plies. As such, the pressure exerted by the "soft" side can be more evenly distributed compared to the conventional closed-mold tooling. In addition, the surface quality is less critical because it is not exposed. Moreover, the method of manufacture of the present technology yields a hollow composite structure, and allows the use of lighter weight, non-structural (i.e., non load-bearing) materials for the trailing and leading elements 316, 318. Based on industry benchmark studies, a mast 310 in accordance with the present technology is at least 0.5 pounds lighter than hydrofoil masts currently on the market, which has a significant effect on buoyancy and ease of maneuvering, both in the water and on the beach. Furthermore, material costs are significantly lower with hollow structures due to less material usage.

Referring again to FIG. 5, in some embodiments the mast 310 may also include a connection interface 565 situated at least partly within the channel 474 of the mast structure 310 and configured to provide an interface for connecting the mast 310 to a board. The connection interface 565 can be a composite, metal, or plastic component that is removable or permanently positioned within the channel 474. The connection interface 565 includes a portion that extends a distance within the channel 574 in order to provide a suitably strong connection between the mast 310 and a board. The distance to which the connection interface 565 extends within the mast 310 can be selected base on the material used to make the connection interface 565, the length of the mast 310, the type of connection elements used to connect the board and the mast 310, and the intended performance level of the hydrofoil assembly, among other factors.

The connection interface 565 can include one or more threaded channels 567*a* and 567*b* for receiving a connection element, such as a bolt, for securing the mast 310 directly to a watersports board. In these and other embodiments, the connection interface 565 can be configured to be indirectly coupled to a watersports board via an adaptor component. For example, in some embodiments the connection interface 565 is configured to receive and/or be detachably coupled to a plurality of different adaptors (including connection adapter 319 illustrated in FIG. 3), each of which is configured to detachably couple to a different watersports board. Connection interface 565 therefore provides a versatile and/or universal interface for connecting the mast 310 to a range of watersports boards.

In certain embodiments, the connection interface 565 is disposed within one of the first or second sections 460*a* or 460*b* (FIG. 4) as the sections are bonded together, such that it is permanently included within the channel 474 of the mast structure 310. In other embodiments, the connection interface 565 may be insertable into and/or removable from the channel 474 after the first and second sections 460*a* and 460*b* have been bonded together. As described above, in some embodiments, the trailing and leading elements 316 and 318 are adhesively bonded to the mast structure 315 such that a user cannot easily detach them from the mast structure 315. In other embodiments, the trailing and leading elements 316 and 318 can be detachably coupled to the mast structure 315 such that a user can easily detach them.

In certain embodiments, other features or components can be positioned at least partly within the channel 474 of the mast structure 310. For example, a battery, sensors, and/or other electronic components can be situated within the channel 474 and configured to provide other functionality to the hydrofoil assembly 200.

3.0 SELECTED EMBODIMENTS OF LOWER ASSEMBLIES AND METHODS OF MANUFACTURE

Figure 6:
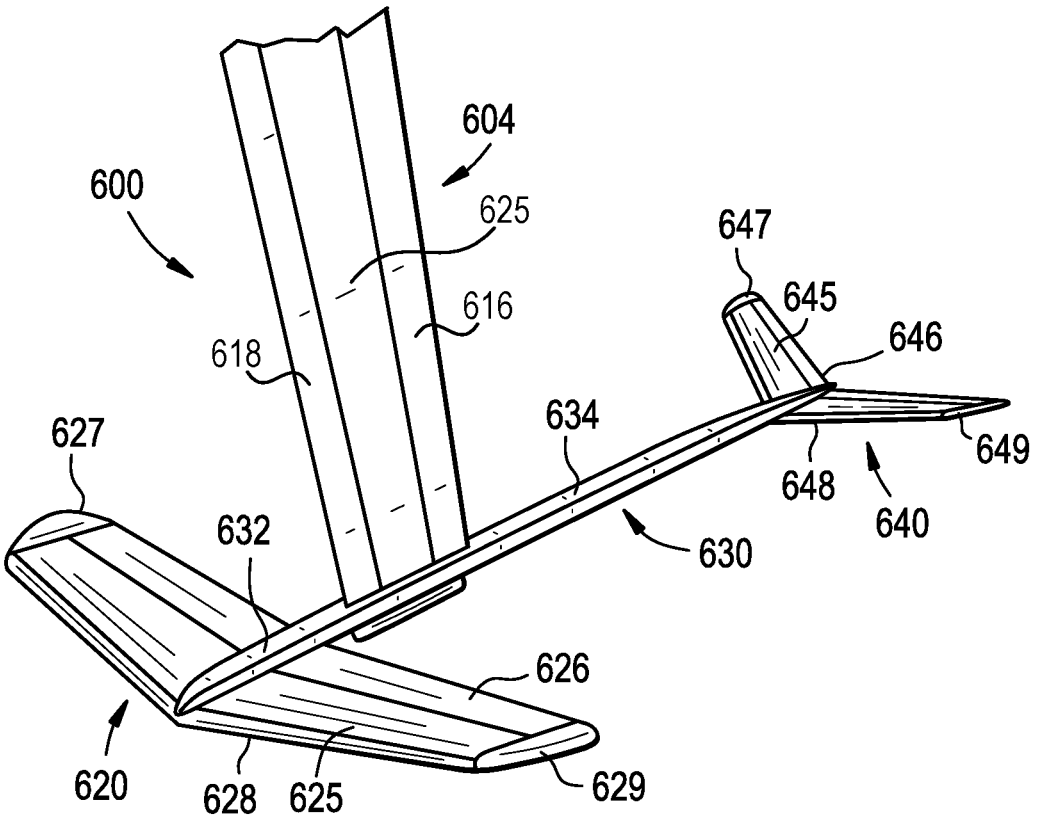
FIG. 6 is an isometric, enlarged view of one embodiment of a lower assembly configured in accordance with the present technology.

FIG. 6 is an isometric view of one embodiment of a lower assembly 600 for use with the hydrofoil assemblies described herein. As shown in FIG. 6, the lower assembly 600 can include a fuselage 630 configured to be coupled to a lower portion of a hydrofoil mast (as shown in FIG. 6), a front wing 620, and a rear wing 640. The front wing 620 is coupled to a leading portion 632 of the fuselage 630, and a rear wing 640 is coupled to a trailing portion 634 of the fuselage 630. In certain embodiments, the front wing 620 and/or the rear wing 640 are components that are separate from the fuselage 630 and are configured to be detachably or permanently coupled to the fuselage 630. In other embodiments, the front wing 620 and/or the rear wing 240 are integrally formed with the fuselage 630. In some embodiments, all or a portion of the fuselage 630, the front wing 620, and/or the rear wing 640 may be formed from a composite material. In other embodiments, one or more components of the lower assembly 600 may not include a composite material and may be formed of other suitable materials.

The front and rear wings 620, 630 will now be described in greater detail. The front wing 620 can be shaped to provide upwards lift while the hydrofoil assembly advances through the water. The rear wing 640 can be shaped to provide upwards lift, downwards lift, and/or no lift. The rear wing 640 can also be generally shaped to provide pitch stabilization for the front wing 620 and/or the associated watersports board. In the embodiment shown in FIG. 6, the front and rear wings 620, 640 include a front and rear wing structure 625, 646, respectively, extending laterally away from the fuselage 630. The front wing structure 625 can be coupled along its trailing edge to a separate trailing element 626 and coupled along its leading edge to a separate leading element 628. In other embodiments, one or more of the front wing structure 625, the trailing element 626, and the leading element 628 are integrally formed. The rear wing structure 645 can be coupled along its trailing edge to a separate trailing element 646 and coupled along its leading edge to a separate leading element 648. In other embodiments, one or more of the rear wing structure 645, the trailing element 646, and the leading element 648 are integrally formed. In embodiments where the front wing 620 and/or rear wing 640 are integrally formed, the leading and trailing elements 628/648, 626/646 can be permanently mounted to the front/rear wing structure 625/645 via "insert molding," in which the front/rear wing structure 625/645 is placed into a mold and the leading and trailing elements 628/648, 626/646 are injected around the front/rear wing structure 625/645. Insert molding requires expensive tooling but can yield a clean surface for the leading and trailing elements 628/648, 626/646 and can reduce manufacturing variability.

In certain embodiments, the front and/or rear wing structure 625, 645 is a composite structure made from two or more pieces (or sections) of molded, composite material. For example, similar to the mast structure 215 described above, the front and/or rear wing structures 625, 645 may individually include at least a first section and a second section bonded together such that the at least a portion of the first section and at least a portion of the second section define a channel extending through the respective wing structure 625, 645. In some embodiments, one or both of the front and rear wing structures 625 and 645 may be manufactured in a similar manner as the mast structure 315, as described in detail above. For example, the first and second sections may each include a flange portion and can be bonded together at their respective flange portions, thereby defining a leading surface and a trailing surface as described above with respect to the mast structure 315. In other embodiments, the front and/or rear wing structures 625, 645 can be a solid, continuous structure comprised of a single material or a sandwich structure. Trailing and leading elements 626 and 628 can be adhesively bonded to such flange portions of the front wing structure 625. Likewise, the trailing and leading elements 646 and 648 can be adhesively bonded to flange portions of the rear wing structure 645. In such embodiments, the leading and trailing elements are generally non-loading bearing and thus can be made of lighter and/or softer materials. In some embodiments, the leading and trailing elements 628/648, 626/646 of the front wing 620 and/or rear wing 640 are made from the same material as the leading and trailing elements of the mast. For example, the leading and trailing elements 628/648, 626/646 can be made from either thermoplastic or thermosetting polymers including ABS, silicone, polyurethane, or other similar materials in varying density from solid to foam. In some embodiments the leading and trailing elements 628/648, 626/646 can be artistic in nature, and can be fabricated from natural materials such as wood, to give the front wing 620 and/or rear wing 640 unique properties and a unique appearance.

In those embodiments where at least one of the front and rear wing structures 620, 640 include a wing structure formed of a composite material and light-weight leading and trailing elements, the weight of the resulting hydrofoil assembly is reduced, thereby increasing its buoyancy and providing several advantages over traditional hydrofoils. For example, unlike many conventional hydrofoils, the hydrofoil assemblies disclosed herein can float with the associated mast coplanar to the water surface. This feature improves the usability of the hydrofoil assembly at least with windsport boards (e.g., a kiteboard) as it provides a platform on which the rider can rest their feet and react to sail or kite loads, thereby allowing a rider to more easily mount the board during a water-start. Additionally, by floating higher in the water, the hydrofoil assemblies disclosed herein have more clearance in shallow water which reduces the likelihood of damage as the assembly drifts into shallow water (such as during ingress/egress from the water near shore). As described below, impact loads from hitting any objects in the water can be handled by replaceable trailing elements, leading elements, and wingtips.

In addition to leading element 628 and trailing element 626, the front wing 620 can further comprise a first wingtip 627 and second wingtip 629. Wingtips 627 and 629 can be coupled to the front wing structure 625, leading element 628, and/or trailing element 626. In some embodiments, the wingtips 627 and 629 are adhesively bonded to the front wing structure 625 via a flange portion of the front wing structure 625 in a similar manner to the leading and trailing elements of the mast, as described above. In certain embodiments, the trailing and leading elements 626 and 628 are also detachably coupleable from the front wing structure 625. In such embodiments, the wingtips 627 and 629 can be coupled to the trailing and leading elements 626 and 628 in order to secure the trailing and leading elements 626 and 628 to the front wing structure 625. In other embodiments, the wingtips 627 and 629 can be permanently mounted to the front wing structure 625 via, for example, "insert molding," in which the front wing structure 625 is placed into a mold and the wingtips 627 and 629 are injected around the front wing structure 625. Insert molding requires expensive tooling but can yield a clean surface for the wingtips 627 and 629 and reduce manufacturing variability. In some embodiments, the front and/or rear wing 620, 640 do not include wingtips. For example, by omitting wingtips, the front and/or rear wing 620, 640 can be manufactured at reduced cost and with less complexity.

Each component of the front wing 620 illustrated in FIG. 6 combines to give the front wing 620 a hydrodynamic profile that provides upwards lift to the hydrofoil assembly 600 when it advances through the water. In the embodiment illustrated in FIG. 6, the front wing 620 has a generally triangular or delta-like shape. The hydrodynamic profile of the front wing has a large impact on the performance and feel of the hydrofoil assembly 600 when it is combined with a board for watersports. For example, a larger forward wing 620 will normally result in more lift and make it easier for a rider to stay up (i.e., remain with the board elevated above the water) at slower speeds. In contrast, a relatively smaller forward wing 620 can reduce drag and allow for higher speeds and maneuverability. Additionally, riders with greater weight will typically need a larger front wing than riders who weigh less. The optimal wing configuration for a rider therefore depends on their skill-level, desired performance, and weight, among other factors. Embodiments of the present technology permit a common forward wing structure 625 to be customized for riders of various weights and abilities. For example, the hydrofoil assembly 600 can be provided with two or more leading elements 628, trailing elements 626, and/or first and second wingtips 627 and 629, of any manner of different shapes and sizes. A rider or multiple riders could therefore attach different front wing components to change the hydrodynamic profile of the front wing 620 in order to affect the performance of the hydrofoil assembly 600.

In the embodiment illustrated in FIG. 6, the rear wing 640 can have similar features as the front wing 640 described above. For example, in addition to leading element 648 and trailing element 646, the rear wing 640 can further comprise a first wingtip 647 and second wingtip 649. Wingtips 647 and 649 can be coupled to the rear wing structure 645, leading element 648, and/or trailing element 646. In some embodiments, the wingtips 647 and 649 are adhesively bonded to rear wing structure 645 via a flange portion (not pictured) of the rear wing structure 645. In other embodiments, the trailing and leading elements 646 and 648 are detachably coupleable from the rear wing structure 645. In certain embodiments, the wingtips 647 and 649 can be coupled to the trailing and leading elements 646 and 648 in order to secure the trailing and leading elements 646 and 648 to the rear wing structure 645.

In some embodiments, the rear wing 640 may have less surface area than the front wing 620. The components of the rear wing 640 illustrated in FIG. 6 combine to give the rear wing 640 a hydrodynamic profile. In contrast to the front wing 620, the rear wing 640 generally does not have a hydrodynamic profile designed to provide a relatively large amount of upwards lift. Rather, a primary purpose of the rear wing is to provide pitch stability for the hydrofoil assembly 600, and subsequently for an attached board. Therefore, in some embodiments the rear wing 640 has a hydrodynamic profile that provides downwards lift or no lift. In other embodiments, the rear wing 640 can have a hydrodynamic profile that provides a small amount of upwards lift. In yet other embodiments, the rear wing 640 can have other components, such as vertical stabilizers, that provide other hydrodynamic characteristics. Embodiments of the present technology permit a common rear wing structure 645 to be customized so that the rear wing 640 has a different hydrodynamic profile. For example, the hydrofoil assembly 600 can be provided with two or more leading elements 648, trailing elements 646, and/or first and second wingtips 647 and 649, of any manner of different shapes and sizes. A rider or multiple riders could therefore attach different rear wing components to change the hydrodynamic profile of the front wing 640 in order to affect the performance of the hydrofoil assembly 600.

Embodiments of the present technology allow for the leading elements 628 and 648, trailing elements 626 and 646, and wingtips 627/629 and 647/649 of the front and rear wings 620 and 640 to be non-structural and manufactured from relatively soft materials. Making these components out of softer materials makes the hydrofoil assembly 600 safer for a rider, as it reduces the chance of receiving cuts from an errant hydrofoil. Likewise, these components are often subject to impact loads during use and transportation. For example, the wingtips 627/629 and 647/649 frequently bear impact loads when a user rests the hydrofoil assembly 600 on a beach or elsewhere. In addition to providing customization, the non-structural aspect of the various components permits easy replacement and/or repair in the event of damage.

Figure 7A:
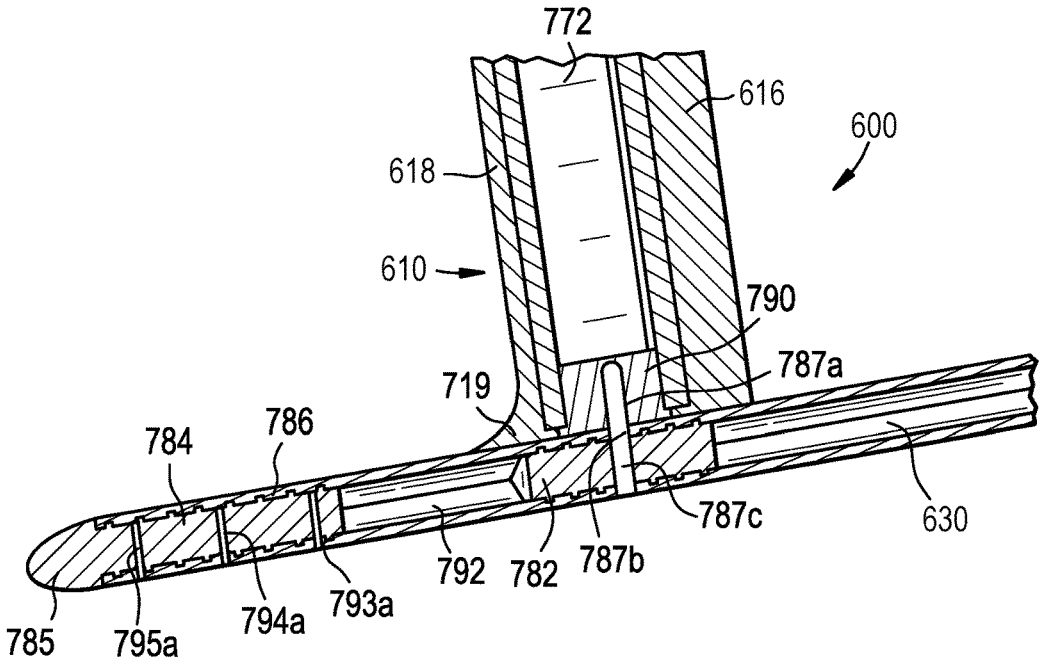
FIG. 7A illustrates a cross-sectional view of the hydrofoil fuselage of the lower assembly shown in FIG. 6.
Figure 7B:
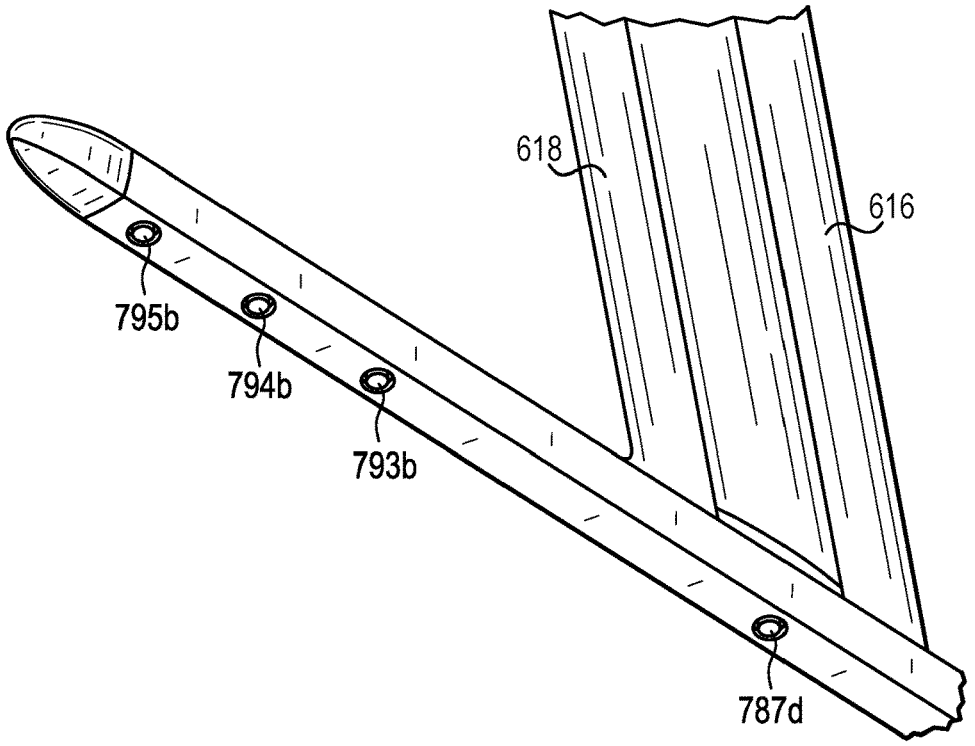
FIG. 7B illustrates an isometric lower view of the hydrofoil mast and fuselage shown in FIG. 7A.

FIG. 7A illustrates a cross-sectional view and FIG. 7B illustrates an isometric view of the lower assembly 600. The fuselage 630 and connection inserts of the lower assembly 600 will now be described in greater detail with reference to FIGS. 7A and 7B. Fuselage 630 has an elongate structure and is configured for attachment to a front wing and a rear wing (not pictured). In the embodiment illustrated in FIGS. 7A and 7B, the fuselage 630 is a composite tube defining channel 792 which extends longitudinally therethrough. Fuselage 630 further has a hexagonal cross-section which provides an index for connecting the fuselage 630 to the mast 310 and wings. The flat surfaces of the fuselage 630 generally simplify the machining and manufacturing of components to be attached to the fuselage 630. However, in some embodiments, the fuselage 630 may have other shapes or sizes. For example, the fuselage can have any other generally polygonal cross-section, such as an octagonal cross-section, or can have a generally circular cross-section. In still other embodiments, the fuselage may be an integral piece without channel 792.

In the illustrated embodiment, mast 310 includes leading element 318 and trailing element 316. Leading element 318 can have a lower portion 719 with a different shape than the rest of the leading element 318. For example, lower portion 719 can have a generally curved shape as illustrated in FIGS. 7A and 7B. Lower portion 719 can provide a greater area of interface for the leading element 318 to couple to fuselage 630, and can also provide additional hydrodynamic characteristics for the hydrofoil assembly 700. For example, curved lower portion 719 can reduce the drag at the interface between the fuselage 630 and mast 310 so as to increase the performance of the hydrofoil assembly 700. In some embodiments, the trailing edge 316 similarly has a different lower portion.

Mast 310 further includes connection interface 790 disposed at least partly within channel 772 and configured to provide an interface for connecting the mast 310 to the fuselage 630. Connection interface 790 can have generally similar features to those of connection interface 565 described above with reference to FIG. 5. For example, connection interface 790 can be a composite, metallic, or plastic box that extends within the channel 772 in order to provide a suitably strong connection between the mast 310 and the fuselage 630. How far connection element 790 must extend within the mast 310 to provide a suitably strong connection depends on the material used to make the connection interface 790, the length of the mast 310, the type of connection elements used to connect the mast 310 and fuselage 630, and the desired performance characteristics of the hydrofoil assembly 700, among other factors. As shown, connection interface 790 can include at least one hole 787*a* for receiving a connection element, such as a bolt, for securing the mast 310 to the fuselage 630. In some embodiments, hole 787*a* is threaded and does not extend fully through the connection interface 790 to prevent water ingress inside the mast 310. In other embodiments, the connection interface 790 includes two or more holes.

In the embodiment shown in FIGS. 7A and 7B, fuselage 630 further includes a first connection insert 782 and a second connection insert 784. First connection insert 782 is completely within channel 792 and is configured to provide an interface for connecting the mast 310 to the fuselage 630 and to help support compressive loads that develop when the connection elements are torqued. In particular, connection insert 782 includes at least one hole 787*c* extending through the connection insert 782 for receiving a connection element therethrough. In some embodiments, hole 787*c* is threaded and is perpendicular to a longitudinal axis of the connection insert 782 and channel 792. In the illustrated embodiment, hole 787*c* is aligned along a common axis with hole 787*a* of the connection interface 790, and with holes 787*b* and 787*d* in the fuselage 630. A connection element, such as a bolt or screw, can therefore be inserted into the contiguous hole 787 to secure the fuselage 630 to the mast 310 via the connection insert 782 and connection interface 790. Two or more connection elements (and therefore two or more holes) may be required depending on the materials used for the connection interface 790, connection insert 782, connection element, etc., and the loads born by each.

Fuselage 630 also includes second connection insert 784 configured to provide an interface for connecting a front wing to the fuselage 630. Second connection insert 784 has a first portion 785 that extends outside of the fuselage channel 792 and a second portion 786 that is situated within the channel 792. The first portion 785 has a hydrodynamic profile that is configured to reduce drag of the fuselage 630, and is also shaped to prevent water from entering the fuselage channel 792. In the illustrated embodiment, the second portion 786 has three holes 793*a*, 794*a* and 795*a* for receiving a connection element. Holes 793*a*, 794*a* and 795*a* are perpendicular to a longitudinal axis of the connection insert 782 and channel 792, can be threaded, and can extend only partly through the connection insert 786. In other embodiments, the connection insert 786 may include one or any number of holes, and the holes may extend fully through the connection insert 786. In the illustrated embodiment, holes 793*a*, 794*a* and 795*a* are aligned along a common axis with holes 793*b*, 794*b* and 795*b* in the fuselage 630. A connection element, such as a bolt or screw, can therefore be inserted into one or more of holes 793, 794, and 795 to secure the fuselage 630 to a front wing via the connection insert 786.

The connection inserts 782 and 784 can be made of plastic, metallic, composite, or other suitable materials. In one embodiment, the connection inserts 782 and 784 are 3D printed from ABS plastic to exactly match the specifications of the fuselage 630. In other embodiments, the connection inserts 782 and 784 can be made of a plastic material and injection molded. When plastic materials are used, one or both of the connection inserts 782 and 784 may contain one or more metallic inserts defining threaded holes 793*a*, 794*a*, and 795*a*, and/or 787*c*, respectively. Such inserts may be insert molded, press fit, or bonded into connection insert 782 and/or 784 using an adhesive. In other embodiments, the connection inserts 782 and 784 may be metallic and contain discretely machined threaded holes 793*a*, 794*a*, and 795*a*, and/or 787*c*, respectively. The connection inserts 782 and 784 can be interference fit and/or adhesively bonded within the fuselage 630. In the embodiment illustrated in FIG. 7A, the connection inserts 782 and 784 use standoff/bumps to provide indexing to the fuselage channel 792, and to control adhesive bond line thickness. In embodiments that employ an adhesive, the adhesive can be applied directly to the connection inserts 782 and 784 before they are inserted, or the connection inserts 782 and 784 can be designed to contain ports for the injection of adhesive once installed in the fuselage 630.

4.0 SELECTED ALTERNATE EMBODIMENTS OF HYDROFOIL MASTS AND METHODS OF MANUFACTURE

FIGS. 8-15 are cross-sectional end views of different embodiments of hydrofoil masts configured in accordance with the present technology. Referring to FIGS. 8-15 together, each hydrofoil mast 810-1510 includes features generally similar to the features of the mast 310 shown in FIGS. 3-5. Features of the hydrofoil masts 810-1510 that are identified with reference numerals that differ from the reference numerals for the hydrofoil mast 310 shown in FIGS. 3-5 by a multiple of 100 can have the same aspects as the corresponding features of the mast 310, unless noted otherwise. Moreover, it is to be appreciated that certain features or aspects of the hydrofoil masts 310 and 810-1510 disclosed herein in the context of particular embodiments can be combined or eliminated in other embodiments, even if not explicitly noted.

Figure 8:
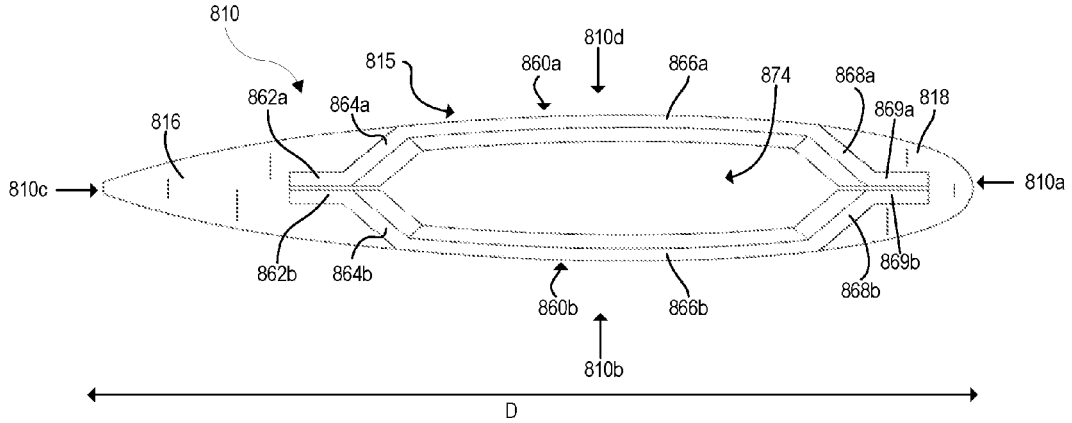
FIGS. 8-11 are cross-sectional end views of different embodiments of hydrofoil masts configured in accordance with the present technology.

In some embodiments, a mast configured according to the present technology can have a mast structure geometry different than that of mast structure 315. Such a configuration, for example, may provide including a more open channel extending therethrough. For example, FIG. 8 shows a mast 810 having a mast structure 815, a trailing element 816, and a leading element 818. The mast 810 further includes a left side 810*d*, a right side 810*b*, a leading edge 810*a*, and a trailing edge 810*c*. The mast structure 815 shown in FIG. 8 includes two sections (referred to as "first section 860*a* and second section 860*b*"). As shown, when the mast structure 815 is assembled, the first section 860*a* includes a trailing flange 862*a*, a trailing spar 864*a* extending from the trailing flange 862*a* towards the left side 810*d* and towards the leading edge 810*a* of the mast 810, a span portion 866*a* extending from the trailing spar 864*a* towards the leading edge 810*a* of the mast 810, a leading spar 868*a* extending from the span portion 866*a* towards the right side 810*b* and towards the leading edge 810*a* of the mast 810, and a leading flange 869*a* extending from the leading spar 868*a* towards the leading edge 810*a* of the mast 810. Likewise, the second section 860*b* includes a trailing flange 862*b*, a trailing spar 864*b* extending from the trailing flange 862*b* towards the right side 810*b* and towards the leading edge 810*a* of the mast 810, a span portion 866*b* extending from the trailing spar 864*b* towards the leading edge 810*a* of the mast 810, a leading spar 868*b* extending from the span portion 866*b* towards the left side 810*d* and towards the leading edge 810*a* of the mast 810, and a leading flange 869*b* extending from the leading spar 868*b* towards the leading edge 810*a* of the mast 810. Unlike the mast structure 315 shown in FIG. 4, the trailing spars 864*a*/864*b* and leading spars 868*a*/868*b* of mast structure 815 extend at a non-90 degree angle with respect to a depth dimension D of the mast 810.

In the assembled configuration, the inner surfaces of the first section's trailing spar 864*a*, span portion 866*a*, and leading spar 868*a* and the inner surfaces of the second section's trailing spar 864*b*, span portion 866*b*, and leading spar 868*b* together surround and define a channel 874 extending the length of the mast structure 815. In other embodiments, the mast structure 815 may define two or more channels. The portions of the first and second sections 860*a*, 860*b* that define the channel 874 together form a generally hexagonal cross-sectional shape that can have no curved sides, or one or more curved sides. For example, in the embodiment illustrated in FIG. 8, the span portions 866*a* and 866*b* can be slightly curved, while the trailing spars 864*a*, 864*b* and leading spars 868*a*, 868*b* are generally straight. In other embodiments the trailing spars 864*a*, 864*b* and leading spars 868*a*, 868*b* can be generally curved, and/or the span portions 866*a* and 866*b* can be straight. Compared to the mast structure 315 shown in FIG. 4, the mast 810 can have a relatively larger channel 874 which can help reduce the material costs and weight of the mast 810. Specifically, the spars 864*a*/868*a* and 864*b*/868*b* can be manufactured to form a greater interior angle with the span portions 866*a* and 868*b*, respectively. Such a configuration can permit the spars 864*a*/868*a* and 864*b*/868*b* to be manufactured to be generally straight (i.e., sufficient pressure can be applied within the mold to form the spars with no, or less, curved portions). Including straight spars 864*a*/868*a* and 864*b*/868*b* can improve the quality of the connection of the joint between the leading and trailing elements 816, and 818, and can reduce manufacturing complexity. For example, the leading and trailing elements 816, 818 need to be manufactured with a curved portion to match the shape of the spars 864*a*/868*a* and 864*b*/868*b*.

Figure 9:
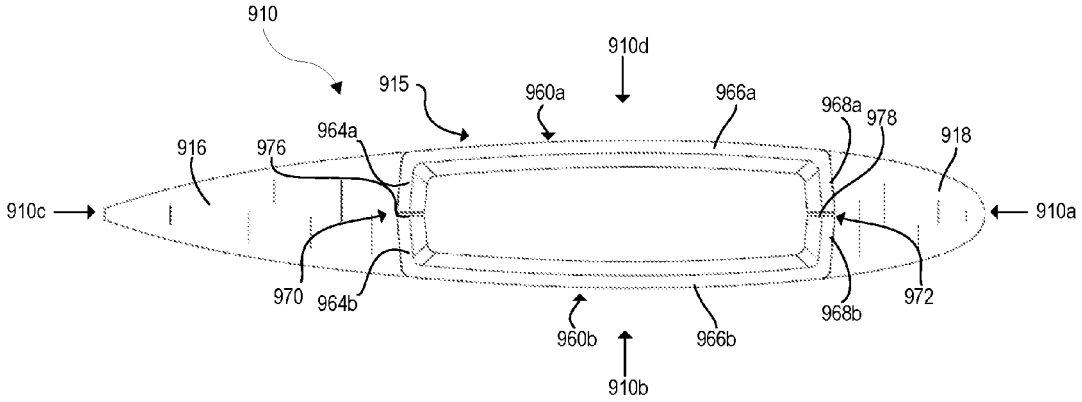

In some embodiments, a mast configured according to the present technology can have a mast structure that includes less than two flange portions (e.g., one flange portion or no flange portion). For example, FIG. 9 shows a mast 910 having a mast structure 915, a trailing element 916, and a leading element 918. The mast 910 further includes a left side 910*d*, a right side 910*b*, a leading edge 910*a*, and a trailing edge 910*c*. The mast structure 915 shown in FIG. 9 includes two sections (referred to as "first section 960*a* and second section 960*b*"). When the mast structure 915 is assembled, the first section 960*a* includes a trailing spar 964*a*, a span portion 966*a* extending from the trailing spar 964*a* towards the leading edge 910*a* of the mast 910, and a leading spar 968*a* extending from the span portion 966*a* towards the right side 910*b* of the mast 910. Likewise, the second section 960*b* includes a trailing spar 964*b*, a span portion 966*b* extending from the trailing spar 964*b* towards the leading edge 910*a* of the mast 910, and a leading spar 968*b* extending from the span portion 966*b* towards the left side 910*d* of the mast 910. The first and second sections 960*a*, 960*b* can be bonded together at their respective trailing spars 964*a*, 964*b* and leading spars 968*a*, 968*b* to form butt joints 976 and 978, respectively. Alternatively, in some embodiments, the first and second sections 960*a*, 960*b* can be co-cured or co-bonded together, or if a thermoplastic material is used, the first and second sections 960*a*, 960*b* can be welded together to form the butt joints 976, 978.

The outer surfaces of the trailing spars 964*a*, 964*b* together define a trailing surface 970 of the mast structure 915, and the outer surfaces of the leading spars 968*a*, 968*b* together define a leading surface 972 of the mast structure 915. In the embodiment illustrated in FIG. 9, the leading and trailing surfaces 970, 972 have a generally curved shape. In other embodiments, the leading and trailing surfaces 970, 972 can be straight or have any other suitable shape. The trailing element 916 is configured to be coupled (e.g., via adhesive bonding) to the trailing surface 970, while the leading element 918 is configured to be coupled (e.g., via adhesive bonding) to the leading surface 972. In contrast to the embodiment shown in FIGS. 3-5, the leading and trailing elements 918, 916 need not include a slot or other component to fit snugly against the leading and trailing surface 972, 970, respectively. Thus, manufacturing costs and complexity associated with manufacturing the leading and trailing elements 918, 916 can be reduced.

Figure 10:
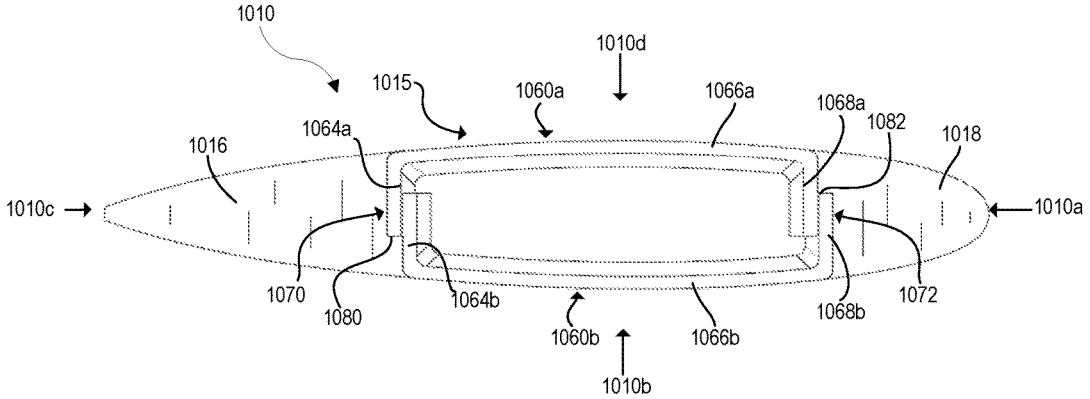

In some embodiments, a mast configured according to the present technology can have a mast structure that includes two composite sections coupled via a lap-shear joint along their respective spar portions. For example, FIG. 10 shows a mast 1010 having a mast structure 1015, a trailing element 1016, and a leading element 1018. The mast 1010 further includes a left side 1010*d*, a right side 1010*b*, a leading edge 1010*a*, and a trailing edge 1010*c*. The mast structure 1015 shown in FIG. 10 includes two sections (referred to as "first section 1060*a* and second section 1060*b*"). When the mast structure 1015 is assembled, the first section 1060*a* includes a trailing spar 1064*a*, a span portion 1066*a* extending from the trailing spar 1064*a* towards the leading edge 1010*a* of the mast 1010, and a leading spar 1068*a* extending from the span portion 1066*a* towards the right side 1010*b* of the mast 1010. Likewise, the second section 1060*b* includes a trailing spar 1064*b*, a span portion 1066*b* extending from the trailing spar 1064*b* towards the leading edge 1010*a* of the mast 1010, and a leading spar 1068*b* extending from the span portion 1066*b* towards the left side 1010*d* of the mast 1010. The first and sections 1060*a*, 1060*b* can be bonded together to form lap-shear joints at overlapping portions of the trailing spars 1064*a*, 1064*b* and leading spars 1068*a*, 1068*b*. For example, in the embodiment illustrated in FIG. 10, an overlapping portion of the outer surface of the trailing spar 1064*b* can be bonded to a portion of the inner surface of the trailing spar 1064*a*. Likewise, an overlapping portion of the outer surface of the leading spar 1068*a* can be bonded to a portion of the inner surface of the leading spar 1068*b*. In other embodiments, the first and second sections 1060*a*, 1060*b* can have different lengths such that the outer surface of one of the sections is bonded to the inner surface of the other section at both spars. As compared to the flangeless mast 910 in FIG. 9, coupling the first and second sections 1060*a*, 1060*b* via lap-shear joints at their respective spars can improve the strength characteristics of the mast 1010. Moreover, the flangeless construction may reduce the amount of material needed to form the mast structure 1015.

The non-overlapping portions of the outer surfaces of the trailing spars 1064*a*, 1064*b* together define a trailing surface 1070 of the mast structure 1015, and the non-overlapping portions of the outer surfaces of the leading spars 1068*a*, 1068*b* together define a leading surface 1072 of the mast structure 1015. As a result of the lap-shear coupling of the first and second sections 1064*a*, 1064*b*, the leading surface 1072 includes a step 1082 and the trailing surface 1070 includes a step 1080. As shown, the leading and trailing elements 1018, 1016 can be shaped to provide a flush fit against the leading surface 1072 and trailing surface 1070, respectively. The steps 1082, 1080 can provide a greater bonding area for and strengthen the coupling with the leading element 1018 and trailing element 1016, compared to, for example, the embodiment illustrated in FIG. 9.

Figure 11:
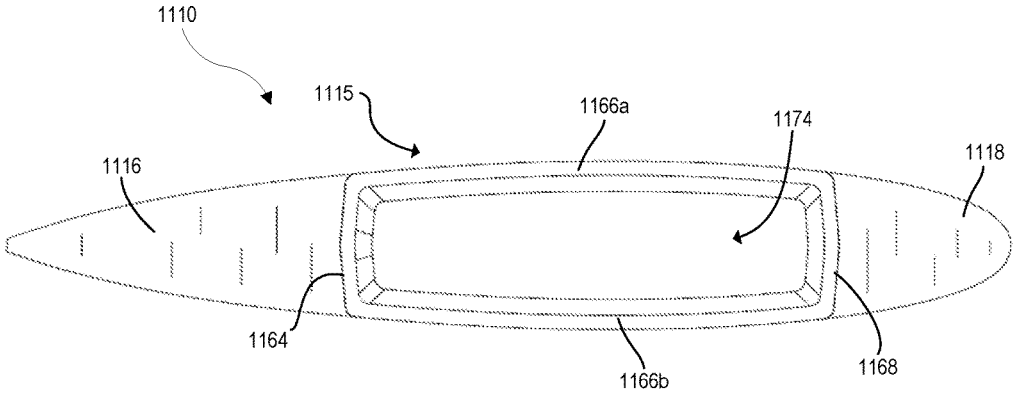

In some embodiments, a mast configured according to the present technology can include a one-piece, continuous mast structure. For example, FIG. 11 shows a mast 1110 having a mast structure 1115, a trailing element 1116, and a leading element 1118. The mast structure 1115 comprises a single continuous piece of composite material including a trailing spar 1164, a leading spar 1168, and two span portions 1166*a*, 1166*b* extending therebetween. The mast 1110 can have features and aspects generally similar to, for example, the embodiment shown in FIG. 9. However, to manufacture the mast structure 1115 including hollow region 1174 can require a more complicated process as compared to the processes for manufacturing a two-section mast structure, as described in further detail above. For example, composite plies can be applied to the inside surface of closed-mold tooling, and one or more inflatable bladders can be used to apply sufficient pressure to an interior surface of the composite structure 1115 during curing. Alternatively, in other embodiments, the composite mast structure 1115 may be formed around a mandrel.

Figure 12:
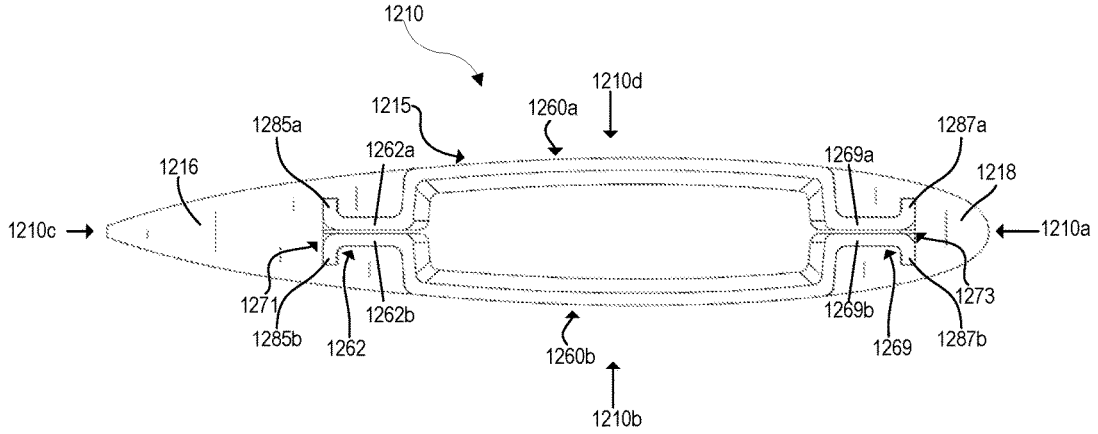
FIGS. 12 and 13 are cross-sectional end views of embodiments of hydrofoil masts including index features configured in accordance with the present technology.

In some embodiments, a mast configured according to the present technology can include one or more indexing features for providing an interference fit between the leading and trailing elements and the mast structure. For example, FIG. 12 shows a mast 1210 having a mast structure 1215, a trailing element 1216, and a leading element 1218. The mast 1210 further includes a left side 1210*d*, a right side 1210*b*, a leading edge 1210*a*, and a trailing edge 1210*c*. The mast structure 1215 includes two sections (referred to as "first section 1260*a* and second section 1260*b*"). The first section 1260*a* includes a trailing flange 1262*a* including a trailing index feature 1285*a*, and a leading flange 1269*a* including a leading index feature 1287*a*. Likewise, the second section 1260*b* includes a trailing flange 1262*b* including a trailing index feature 1285*b*, and a leading flange 1269*b* including a leading index feature 1287*b*. After coupling the first and second sections 1260*a* and 1260*b*, the trailing flanges 1262*a*, 1262*b* and trailing index features 1285*a*, 1285*b* together form a main trailing flange 1262. Likewise, after coupling the first and second sections 1260*a* and 1260*b*, the leading flanges 1269*a*, 1269*b* and leading index features 1287*a*, 1287*b* form a main leading flange 1269.

As shown in FIG. 12, the leading and trailing index features 1287*a*, 1285*a* of the first section 1260*a* can extend from the leading and trailing flanges 1269*a*, 1262*a*, respectively, towards the left side 1210*d* of the mast 1210. Conversely, the leading and trailing index features 1287*b*, 1285*b* of the second section 1260*b* can extend from the leading and trailing flanges 1269*b*, 1262*b*, respectively, towards the right side 1210*d* of the mast 1210. In the embodiment shown in FIG. 12, the trailing index features 1285*a*, 1285*b* extend from a portion of the trailing flanges 1262*a*, 1262*b*, respectively, that is closest to the trailing edge 1210*c* of the mast 1210. Similarly, the leading index features 1287*a*, 1287*b* extend from a portion of the leading flanges 1269*a*, 1269*b*, respectively, that is closest to the leading edge 1210*a* of the mast 1210. In other embodiments, respective ones of the index features may extend from another portion of the respective flanges (e.g., from the middle of the flange or from an end of the flange farthest from an edge of the mast 1210). In some embodiments, the mast structure 1210 includes more or less than four index features (e.g., one, two, three, or five or more index features). In certain embodiments, index features are provided on another surface of the mast structure 1210 besides the flanges 1262*a*, 1262*b* and 1269*a*, 1269*b* (e.g., on the outside surface of leading and/or trailing spars).

The index features 1285*a*, 1285*b* and 1287*a*, 1287*b* (collectively "the index features") can be made of a composite material and can be formed at the same time and as part of the same process as the first and second sections 1260*a*, 1260*b*. The index features can be configured to provide an interference fit with the leading and trailing elements 1218, 1216. For example, each of the leading and trailing elements 1218 and 1216 can include an elongated slot 1273 and 1271, respectively, extending along all or a portion of their respective lengths. Each of the slots 1271, 1273 is configured to receive therein the corresponding main trailing flange 1262 and the main leading flange 1269, respectively. Specifically, the slots 1271, 1273 can be shaped such that they fit snuggly against the flanges 1262 and 1269 (as illustrated in FIG. 12), and provide an interference fit for the leading and trailing elements 1218 and 1216, respectively. The leading and trailing elements 1218 and 1216 can therefore be slotted into place along the length of the mast 1210. In some embodiments, by including the index features, the leading and trailing elements 1218, 1216 can be coupled and secured to the mast structure 1215 only through an interference fit. In such embodiments, the leading and trailing elements 1218, 1216 can be made easily removable from the mast structure 1215. Accordingly, a user could, for example, change out the leading and/or trailing elements 1218, 1216 with other elements (not pictured) to customize the mast 1210. In other embodiments, all or a portion of an inner surface of the trailing element 1216 surrounding the slot 1271 can be adhered to the trailing flange 1262 and/or another surface of the mast structure 1215, and/or all or a portion of an inner surface of the leading element 1218 surrounding the slot 1273 can be adhered to all or a portion of the leading flange 1269 and/or another surface of the mast structure 1215.

Figure 13:
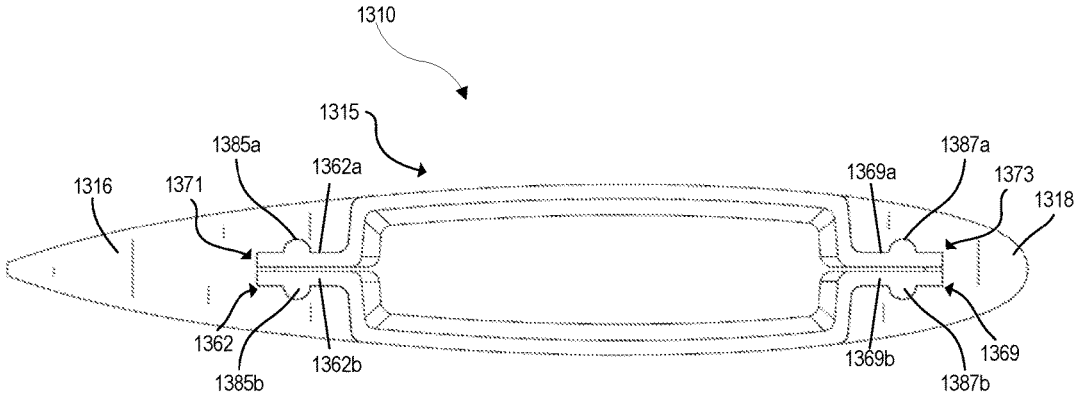

FIG. 13 shows another embodiment of a mast 1310 including leading index features 1387*a*, 1387*b* on leading flanges 1369*a*, 1369*b*, respectively, and trailing index features 1385*a*, 1385*b* on trailing flanges 1362*a*, 1362*b* respectively. The index features 1385*a*, 1385*b* and 1387*a*, 1387*b* (collectively "the index features") can be "bumps," "dimples," or continuous sections of composite material and can be formed at the same time and as part of the same method as the first and second sections 1360*a*, 1360*b*. In the embodiment shown in FIG. 13, respective ones of the index features are disposed generally in the middle of the leading flanges 1369*a*, 1369*b* and trailing flanges 1362*a*, 1362*b*. In other embodiments, the index features may be disposed on other portions of the flanges. The index features can be configured to provide an interference fit with the trailing and leading elements 1316, 1318. For example, elongated slots 1371 and 1373 in the trailing and leading elements 1316, 1318, respectively, can be configured to receive therein a corresponding main trailing flange 1362 and main leading flange 1369, respectively (as described above with reference to FIG. 12). In such an embodiment, the trailing and leading elements 1316, 1318 can be coupled to the mast structure 1315 in a direction parallel to a short length of the main trailing flange 1362 and main leading flange 1369, respectively.

Figure 14:
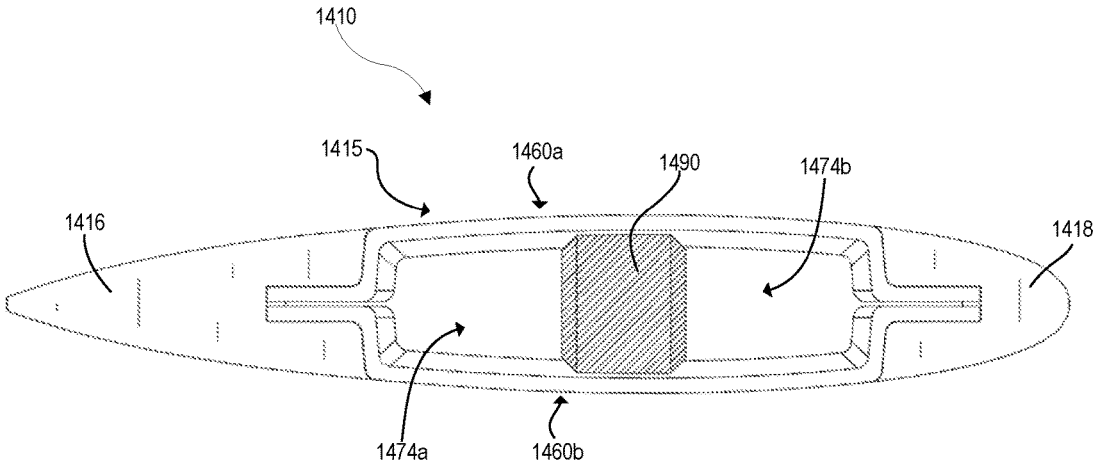
FIGS. 14 and 15 are cross-sectional end views of embodiments of hydrofoil masts including structural members configured in accordance with the present technology.

In some embodiments, a mast configured according to the present technology can include one or more additional structural members within the mast structure. For example, FIG. 14 shows a mast 1410 having a mast structure 1415, a trailing element 1416, and a leading element 1418. The mast structure 1415 includes two sections (referred to as "first section 1460*a* and second section 1460*b*"), and a structural member 1490 disposed between the first and second sections 1460*a*, 1460*b*. Accordingly, the structural member 1490 and first and second sections 1460*a*, 1460*b* can define a leading channel 1474*b* and a trailing channel 1474*a* within the mast structure 1415. The structural member 1490 can be a metal, wood, foam, plastic, composite, or other material and is configured to improve the strength and stiffness characteristics of the mast 1410. As shown in FIG. 14, the structural member 1490 can be a solid piece. In some embodiments, the structural member 1490 can include hollow regions, divots, etc. such that it is not a solid piece. In some embodiments, the structural member 1490 is disposed along the entire length of the first and second sections 1460*a*, 1460*b*. In other embodiments, the structural member 1490 can be disposed along only a portion of the length of the first and second sections 1460*a*, 1460*b* (e.g., to provide a desired increase in strength characteristics while also reducing the weight of the structural support 1490). In yet other embodiments, the mast 1410 can include more than one structural member disposed between the first and second sections 1460*a*, 1460*b*.

The structural member 1490 can be formed separately from the first and second sections 1460*a*, 1460*b* and then disposed between the first and second sections 1460*a*, 1460*b* as they are coupled together to form the mast structure 1415. In certain embodiments, the structural member 1490 is adhered to one or more portions of the interior surface of the mast structure 1415. In other embodiments, the structural member 1490 is disposed within the mast structure 1415 via an interference fit. In still other embodiments, the structural member 1490 can be formed with or at the same as (and by similar processes to) the first and second sections 1460*a*, 1460*b*.

Figure 15:
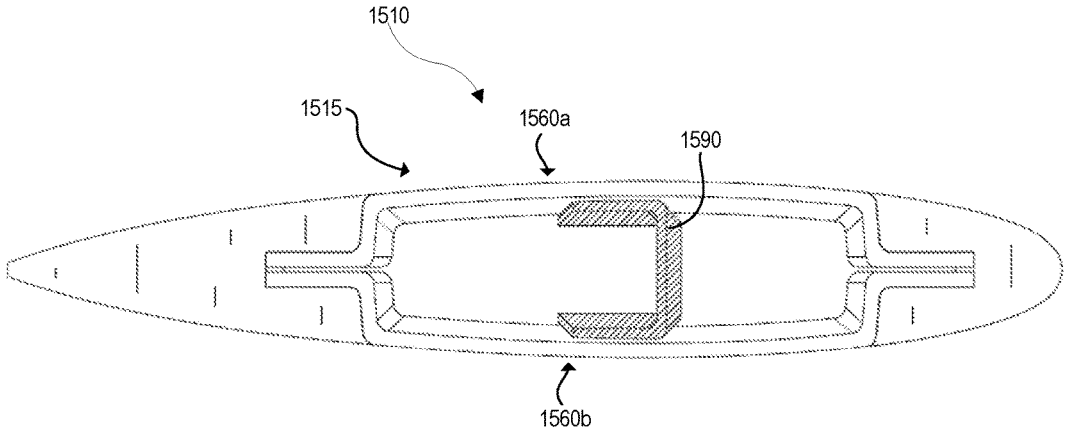

FIG. 15 shows another embodiment of a mast 1510 including mast structure 1515, and with a structural member 1590 disposed within the mast structure 1515. Structural member 1590 has a generally C-like shape. In one embodiment, the structural member 1590 is made of a composite material and can have a high strength-to-weight ratio as compared to the solid structural member shown in the embodiment of FIG. 14. In other embodiments, the structural member 1590 can have other suitable shapes (e.g., an I-beam-like shape) and can be made of other suitably strong materials (e.g., foam, wood, metal, composite, etc.). The structural member 1590 can be a separate component that is disposed between first and second sections 1560*a*, 1560*b* as the sections are coupled together to form the mast structure 1515, or it can be integrally formed with either of the first or second sections 1560*a*, 1560*b*.

5.0 SELECTED EMBODIMENTS OF CONNECTION ELEMENTS

Figure 16:
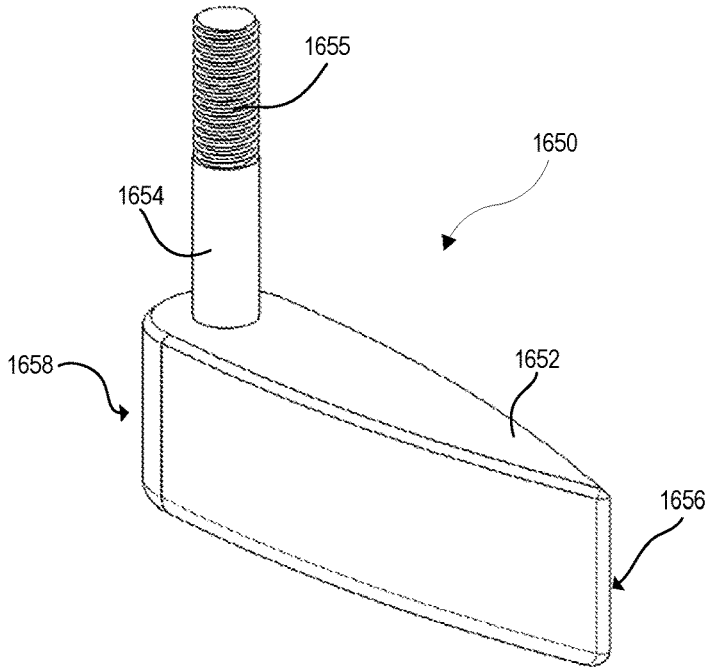
FIGS. 16 and 17 are isometric views of embodiments of connection elements configured in accordance with the present technology.

With reference to FIG. 2, in some embodiments, the connection element 250 can be used to secure the mast 210 to the lower assembly 211. FIG. 16 is an isometric view of one embodiment of a connection element 1650 in accordance with the present technology. As shown, the connection element comprises a head 1652 and a bolt 1654 including threaded portion 1655. The connection element 1650 is configured so that a user may grip the head 1652 to screw the bolt 1654 through the lower assembly 211 (e.g., fuselage 230) and into a lower connection interface of the mast 210. Advantageously, the connection element 1650 does not require an additional tool (e.g., a screw driver) for connecting the lower assembly 211 and mast 210—the user can simply grip and twist the head 1652 to turn the bolt 1654. The head 1652 remains external of the lower assembly 211 and the mast 210 after the connection element 1652 is used to couple the mast 210 to the lower assembly 211. Accordingly, as shown in FIG. 16, the head 1652 can have a generally elongated shape including a leading edge 1658 and a trailing edge 1656 such that the head 1652 has a hydrodynamic profile that minimizes drag. In other embodiments, the head 1652 can incorporate an internal cam to tighten against the threaded portion 1655. In certain embodiments, the connection element 1650 can be used to attach the board 202 to the mast 210.

Figure 17:
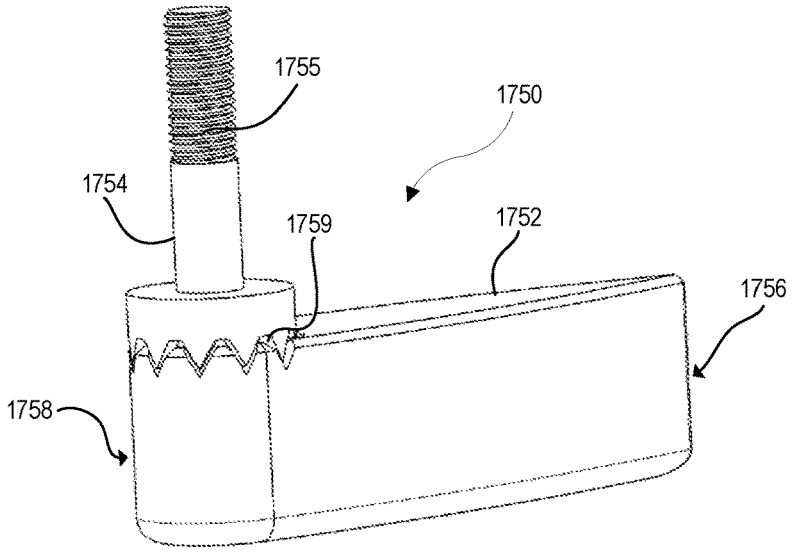

FIG. 17 is an isometric view of another embodiment of a connection element 1750 configured in accordance with the present technology. The connection element 1750 includes features generally similar to the connection element shown in FIG. 16, including a head 1752 and bolt 1754 having threaded portion 1755. The head 1752 can likewise have a leading edge 1758 and trailing edge 1756 that give the head 1752 a faired shape for reducing drag. As shown, the head 1752 is attached to the bolt 1754 via a hirth joint 1759. The hirth joint 1759 allows the user to first tighten (or loosen) the connection between the lower assembly 211 and mast 210 and then line up the head 1752 with the direction of flow (e.g., with the leading edge 1758 facing the same direction as leading element 218 of the mast 210, and the trailing edge

1756 facing the same direction as the trailing element 216 of the mast 210). Such a connection element 1750 could also be used to connect the board 202 to the mast 210.

6.0 CONCLUSION

This disclosure is not intended to be exhaustive or to limit the present technology to the precise forms disclosed herein. Although specific embodiments are disclosed herein for illustrative purposes, various equivalent modifications are possible without deviating from the present technology, as those of ordinary skill in the relevant art will recognize. In some cases, well-known structures and functions have not been shown and/or described in detail to avoid unnecessarily obscuring the description of the embodiments of the present technology. Although steps of methods may be presented herein in a particular order, in alternative embodiments the steps may have another suitable order. Similarly, certain aspects of the present technology disclosed in the context of particular embodiments can be combined or eliminated in other embodiments. Furthermore, while advantages associated with certain embodiments may have been disclosed in the context of those embodiments, other embodiments can also exhibit such advantages, and not all embodiments need necessarily exhibit such advantages or other advantages disclosed herein to fall within the scope of the present technology. Accordingly, this disclosure and associated technology can encompass other embodiments not expressly shown and/or described herein.

Throughout this disclosure, the singular terms "a," "an," and "the" include plural referents unless the context clearly indicates otherwise. Similarly, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the terms "comprising" and the like are used throughout this disclosure to mean including at least the recited feature(s) such that any greater number of the same feature(s) and/or one or more additional types of features are not precluded. Reference herein to "one embodiment," "an embodiment," or similar formulations means that a particular feature, structure, operation, or characteristic described in connection with the embodiment can be included in at least one embodiment of the present technology. Thus, the appearances of such phrases or formulations herein are not necessarily all referring to the same embodiment. Furthermore, various particular features, structures, operations, or characteristics may be combined in any suitable manner in one or more embodiments.

I claim:

1. A hydrofoil for attachment to a board for watersports comprising:

a mast having a first section, a second section, a leading element, and a trailing element, wherein:

the first and second sections are made of a composite material, the first and second sections are coupled together to define a channel, a leading surface, and a trailing surface, the leading element is coupled to the leading surface, the trailing element is coupled to the trailing surface, the first section is an integral composite section having a span portion connected to a leading spar and a trailing spar, a leading flange connected to the leading spar, and a trailing flange connected to the trailing spar, the second section is an integral composite section having a span portion connected to a leading spar and a trailing spar, a leading flange connected to the leading spar, and a trailing flange connected to the trailing spar, and wherein, when the first section is coupled to the second section, the span portions, leading spars, and trailing spars of the first and second sections define the channel, the leading flange of the first section is coupled to the leading flange of the second section, and the trailing flange of the first section is coupled to the trailing flange of the second section;

a fuselage coupled to the mast and having a leading portion and a trailing portion;

a front wing coupled to the leading portion of the fuselage; and a rear wing coupled to the trailing portion of the fuselage.

2. The hydrofoil of claim 1 wherein at least one of the leading element and trailing element are made of a material that is softer than the composite material.

3. The hydrofoil of claim 2 wherein the leading and trailing elements are made of at least one of plastic and silicone.

4. The hydrofoil of claim 1, wherein the leading element is adhesively bonded to the leading flange and the trailing element is adhesively bonded to the trailing flange.

5. The hydrofoil of claim 1 wherein the channel has a cross-sectional shape that is generally rectangular with curved sides.

6. The hydrofoil of claim 1 wherein the trailing element has a tapered end portion and has a longer cross-sectional length than the leading element measured along an axis extending between the trailing element and leading element.

7. The hydrofoil of claim 1 wherein the first and second sections are reflectively symmetric about a plane along which the first and second sections are coupled.

8. The hydrofoil of claim 1 wherein the leading element is a first leading element and the trailing element is a first trailing element, wherein the first leading element is detachably coupleable to the leading surface and the first trailing element is detachably coupleable to the trailing surface, and further comprising:

a second leading element having a different hydrodynamic profile than the first leading element, wherein the second leading element is detachably coupleable to the leading surface;

a second trailing element having a different hydrodynamic profile than the first trailing element, wherein the second trailing element is detachably coupleable to the trailing surface; and wherein, a user of the hydrofoil can selectively couple: (a) one of the first and second leading elements to the leading surface and (b) one of the first and second trailing elements to the trailing surface, in order to change the hydrodynamic profile of the mast.

9. The hydrofoil of claim 1, further comprising a connection interface at least partly within the channel and configured to provide an interface for connecting the board and the mast, wherein the board includes a recess configured to receive a portion of the connection interface, and wherein the portion of the connection interface extends beyond the channel to provide an interface for connecting the board and the mast.

10. The hydrofoil of claim 1, further comprising an adapter configured to removably couple to the mast and to provide an interface for connecting the mast to the watersports board.

11. The hydrofoil of claim 1 wherein the front wing further includes a first section, a second section, a leading element, and a trailing element, wherein:

the first and second sections are made of a composite material, the first and second sections are coupled together to define a channel, a leading surface, and a trailing surface, the leading element is coupled to the leading surface, and the trailing element is coupled to the trailing surface.

12. The hydrofoil of claim 1 further comprising a connection element for connecting the mast and the fuselage, wherein the connection element has an elongated head configured to reduce drag and to be gripped by a user for securing the mast to the fuselage without the use of a tool.

13. The hydrofoil of claim 1 wherein the fuselage has an elongate structure that defines a fuselage channel, wherein the elongate structure has a polygonal cross-section, and wherein the elongate structure is made from a composite material.

14. The hydrofoil of claim 13 further comprising a connection insert, wherein:

the fuselage channel is configured to at least partially receive the connection insert, the connection insert includes at least one opening perpendicular to a longitudinal axis of the connection insert, and the opening is configured to receive a connection element therethrough for connecting the mast to the fuselage.

15. The hydrofoil of claim 13 further comprising a connection insert, wherein:

the fuselage channel is configured to partially receive the connection insert, the connection insert includes at least one opening perpendicular to a longitudinal axis of the connection insert, the opening is configured to receive a connection element therethrough for connecting the front wing to the fuselage, and the connection insert has a leading portion that extends outside of the fuselage channel and is configured to reduce the drag of the leading portion of the fuselage when the hydrofoil assembly advances through water.

16. A hydrofoil for attachment to a board for watersports comprising:

a mast having a first section, a second section, a leading element, and a trailing element, wherein:

the first and second sections are made of a composite material, the first and second sections are coupled together to define a channel, a leading surface, and a trailing surface, the leading element is coupled to the leading surface, and the trailing element is coupled to the trailing surface, wherein the trailing element has a tapered end portion and has a longer cross-sectional length than the leading element measured along an axis extending between the trailing element and leading element;

a fuselage coupled to the mast and having a leading portion and a trailing portion;

a front wing coupled to the leading portion of the fuselage; and a rear wing coupled to the trailing portion of the fuselage.

17. A hydrofoil for attachment to a board for watersports comprising:

a mast having a first section, a second section, a leading element, and a trailing element, wherein:

the first and second sections are made of a composite material, the first and second sections are coupled together to define a channel, a leading surface, and a trailing surface, the leading element is coupled to the leading surface, and the trailing element is coupled to the trailing surface;

a fuselage coupled to the mast and having a leading portion and a trailing portion;

a front wing coupled to the leading portion of the fuselage; and a rear wing coupled to the trailing portion of the fuselage, wherein the leading element is a first leading element and the trailing element is a first trailing element, wherein the first leading element is detachably coupleable to the leading surface and the first trailing element is detachably coupleable to the trailing surface, and further comprising:

a second leading element having a different hydrodynamic profile than the first leading element, wherein the second leading element is detachably coupleable to the leading surface;

a second trailing element having a different hydrodynamic profile than the first trailing element, wherein the second trailing element is detachably coupleable to the trailing surface; and wherein, a user of the hydrofoil can selectively couple: (a) one of the first and second leading elements to the leading surface and (b) one of the first and second trailing elements to the trailing surface, in order to change the hydrodynamic profile of the mast.

* * * * *